US009909081B2

(12) United States Patent
Scanlon et al.

(10) Patent No.: US 9,909,081 B2
(45) **Date of Patent: *Mar. 6, 2018**

(54) ALKOXYLATED AMIDES, ESTERS, AND ANTI-WEAR AGENTS IN LUBRICANT COMPOSITIONS

(71) Applicant: BASF SE, Ludwigshafen (DE)

(72) Inventors: Eugene Scanlon, Mamaroneck, NY (US); Thomas Hayden, Wappingers Falls, NY (US); Alfred Jung, Carmel, NY (US); Michael Hoey, Maplewood, NJ (US)

(73) Assignee: BASF SE, Ludwigshafen (DE)

( * ) Notice: Subject to any disclaimer, the term of this patent is extended or adjusted under 35 U.S.C. 154(b) by 84 days.

This patent is subject to a terminal disclaimer.

(21) Appl. No.: 14/926,988

(22) Filed: Oct. 29, 2015

(65) Prior Publication Data

US 2016/0208187 A1 Jul. 21, 2016

Related U.S. Application Data

(60) Provisional application No. 62/073,267, filed on Oct. 31, 2014, provisional application No. 62/205,297, filed on Aug. 14, 2015.

(51) Int. Cl.
*C10M 141/10* (2006.01)
*C10M 133/16* (2006.01)
(Continued)

(52) U.S. Cl.
CPC ..... *C10M 141/10* (2013.01); *C10M 133/06* (2013.01); *C10M 133/16* (2013.01);
(Continued)

(58) Field of Classification Search
CPC ..... C10N 2230/54; C10M 133/16; C10M 129/70
(Continued)

(56) References Cited

U.S. PATENT DOCUMENTS 2,252,889 A 8/1941 Haseltine
3,807,973 A 4/1974 Iwama et al.
(Continued)

FOREIGN PATENT DOCUMENTS

DE 10 2006 006 252 A1 9/2006
EP 0 743 354 A1 11/1996
(Continued)

OTHER PUBLICATIONS

International Search Report for Application No. PCT/US2009/047510 dated Aug. 4, 2009, 4 pages.
(Continued)

*Primary Examiner* — Ellen M McAvoy
(74) *Attorney, Agent, or Firm* — Lowenstein Sandler LLP

(57) ABSTRACT

The present disclosure provides an additive package for a lubricant composition that includes an alkoxylated amide, an ester, and an anti-wear agent including phosphorus, molybdenum, or a combination thereof. The present disclosure also provides a lubricant composition that includes a base oil, the alkoxylated amide, the ester, and the anti-wear agent including phosphorus, molybdenum, or a combination thereof. The present disclosure further provides a method of lubricating an internal combustion engine for improving fuel economy.

19 Claims, 2 Drawing Sheets

(51) Int. Cl.
*C10M 141/12* (2006.01)
*C10M 133/06* (2006.01)
*C10M 137/10* (2006.01)

(52) U.S. Cl.
CPC ..... *C10M 137/10* (2013.01); *C10M 141/12* (2013.01); *C10M 2203/1006* (2013.01); *C10M 2203/1025* (2013.01); *C10M 2205/0285* (2013.01); *C10M 2207/28* (2013.01); *C10M 2215/082* (2013.01); *C10M 2223/045* (2013.01); *C10N 2210/02* (2013.01); *C10N 2230/06* (2013.01); *C10N 2230/54* (2013.01); *C10N 2240/10* (2013.01)

(58) Field of Classification Search
USPC ..... 508/555, 500
See application file for complete search history.

(56) References Cited

U.S. PATENT DOCUMENTS 4,185,594 A 1/1980 Perilstein
4,201,684 A * 5/1980 Malec ..... C10M 135/02 508/328
4,204,481 A 5/1980 Malec
4,208,190 A 6/1980 Malec
4,280,916 A 7/1981 Richards et al.
4,389,322 A 6/1983 Horodysky
4,419,255 A 12/1983 Kaufman et al.
4,427,562 A 1/1984 Horodysky et al.
4,428,182 A 1/1984 Allen et al.
4,439,336 A 3/1984 Zaweski
4,446,038 A 5/1984 Schlicht et al.
4,512,903 A 4/1985 Schlicht et al.
4,525,288 A 6/1985 Schlicht
4,640,791 A * 2/1987 Deck ..... C10M 173/00 252/75
4,647,389 A 3/1987 Karol et al.
4,729,769 A 3/1988 Schlicht et al.
4,737,160 A 4/1988 Efner
4,765,918 A 8/1988 Love et al.
5,028,345 A 7/1991 Everett et al.
5,229,033 A 7/1993 Nguyen et al.
5,275,745 A * 1/1994 Habeeb ..... C10M 135/16 508/257
5,339,855 A * 8/1994 Hellsten ..... C09K 3/00 137/13
5,352,374 A 10/1994 Habeeb et al.
5,523,431 A 6/1996 Skold
5,719,109 A 2/1998 Tokashiki et al.
5,891,203 A 4/1999 Ball et al.
5,911,236 A * 6/1999 Hellsten ..... B01F 17/0085 137/13
5,979,479 A * 11/1999 Hellsten ..... C09K 3/00 137/13
6,034,257 A 3/2000 Oftring et al.
6,057,273 A * 5/2000 Oumar-Mahamat .... C10L 1/143 508/551
6,277,158 B1 8/2001 McLean
6,277,191 B1 8/2001 Budiansky et al.
6,358,896 B1 * 3/2002 Gutierrez ..... C10M 129/68 508/501
6,524,353 B2 2/2003 de Rosa et al.
6,531,443 B2 * 3/2003 Perella ..... C07C 233/18 510/501
6,534,464 B1 3/2003 Huish et al.
6,589,302 B1 7/2003 DeRosa et al.
6,689,908 B1 2/2004 Le Helloco et al.
6,743,266 B2 6/2004 DeRosa et al.
6,746,988 B2 6/2004 Hopkinson et al.
6,764,989 B1 7/2004 Huish et al.
6,786,939 B2 9/2004 Hazel et al.
7,022,653 B2 * 4/2006 Hartley ..... C10M 141/08 508/364
7,645,728 B2 1/2010 Esche, Jr. et al.
7,902,131 B2 * 3/2011 Aguilar ..... C10M 141/06 508/189
8,388,704 B2 3/2013 Watanabe et al.
8,425,627 B2 4/2013 Dietz et al.
8,455,413 B2 * 6/2013 Hiyoshi ..... C07C 219/06 508/459
8,921,288 B2 * 12/2014 Gieselman ..... C10M 133/06 508/476
9,279,094 B2 * 3/2016 Styer ..... C10M 133/16
9,447,351 B2 * 9/2016 Jung ..... C10L 1/22
9,562,207 B2 * 2/2017 DeBlase ..... C10M 133/16
2003/0056431 A1 3/2003 Schwab et al.
2003/0091667 A1 5/2003 Gormley et al.
2004/0154217 A1 8/2004 Watanabe et al.
2004/0154218 A1 8/2004 Watanabe et al.
2004/0231233 A1 11/2004 Rae et al.
2005/0026805 A1 2/2005 Queen
2005/0053681 A1 3/2005 Gormley et al.
2006/0047141 A1 3/2006 Behler et al.
2006/0196111 A1 9/2006 Colucci
2006/0223718 A1 * 10/2006 Bastien ..... C10M 169/04 508/365
2006/0254129 A1 11/2006 Braakman et al.
2006/0276354 A1 * 12/2006 Donaghy ..... C10M 129/76 508/485
2007/0254821 A1 11/2007 Aguilar et al.
2009/0163393 A1 * 6/2009 Boffa ..... C10M 111/02 508/496
2010/0006049 A1 1/2010 Jung et al.
2010/0056407 A1 3/2010 Sheets et al.
2010/0080767 A1 4/2010 Queen
2010/0236140 A1 9/2010 Voelkel et al.
2012/0291737 A1 11/2012 Mathur et al.

FOREIGN PATENT DOCUMENTS

EP 0 936 265 A1 8/1999
EP 1 785 471 A1 5/2007
EP 2 161 326 A1 3/2010
JP S 60-137998 A 7/1985
JP H 07-233390 A 9/1995
JP H 11-21575 A 1/1999
JP H 11-256180 A 9/1999
JP 2001-505934 A 5/2001
JP 2004-210984 A 7/2004
WO WO 92/19587 A1 11/1992
WO WO 94/19434 A1 9/1994
WO WO 95/15368 A1 6/1995
WO WO 98/16599 A1 4/1998
WO WO 99/46356 A1 9/1999
WO WO 2005/113694 A1 12/2005
WO WO 2007/053787 A1 5/2007
WO WO 2008/063501 A1 5/2008
WO WO 2009/050256 A1 4/2009
WO WO 2010/005720 A1 1/2010

OTHER PUBLICATIONS

Written Opinion for Application No. PCT/US2009/047510 dated Aug. 4, 2009, 5 pages.
Fujita, H. et al., "Study of Zinc Dialkydithiophosphate Antiwear Film Formation and Removal Processes, Part I: Experimental", Tribology Transactions, 48, 4, 2005, pp. 558-566.
Tang, Z. et al., "A Review of Recent Developments of Friction Modifiers for Liquid Lubricants", Current Opinion in Solid State and Materials Science, 18, 2004, pp. 119-139.
Ushioda, N. et al., "A Study of Fuel Economy Additive Formulation Technology for Passenger Car Motor Oil and Development of a Screener Test for Fuel Economy," Tribology Online, 8, 1, 2013, pp. 64-67.
Weil, J.K., et al., "Tallow Alkanolamides: Preparation and Effect on Surfactant Solutions", Eastern Regional Research Laboratory, Philadelphia, PA, Mar. 15, 1971, pp. 674-677.
Yamamoto, K. et al., "Additives for Improving the Fuel Economy of Diesel Engine Systems," Tribology Online, 5, 4, 2010, pp. 195-198.

(56) References Cited

OTHER PUBLICATIONS

Liu, Q. et al., "Chemical Abstracts Service" Columbus, Apr. 22, 2008, XP-002538492.
English language abstract not found for DE 10 2006 006 252; however, see English language equivalent U.S. 2006/0196111. Original document extracted from espacenet.com database on Dec. 10, 2015, 14 pages.
English language abstract for JPS 60-137998 extracted from espacenet.com database on Dec. 10, 2015, 1 page.
English language abstract and machine-assisted English translation for JPH 07-233390 extracted from espacenet.com database on Dec. 10, 2015, 14 pages.
English language abstract and machine-assisted English translation for JPH 11-21575 extracted from espacenet.com database on Dec. 10, 2015, 16 pages.
English language abstract for JPH 11-256180 extracted from espacenet.com database on Dec. 10, 2015, 1 page.
English language abstract not found for JP 2001-505934; however, see English language equivalent WO 98/16599. Original document extracted from espacenet.com database on Dec. 10, 2015, 80 pages.
English language abstract for JP 2004-210984 extracted from espacenet.com database on Dec. 10, 2015, 1 page.
International Search Report for Application No. PCT/US2015/058009 dated Feb. 17, 2016, 3 pages.

* cited by examiner

ALKOXYLATED AMIDES, ESTERS, AND ANTI-WEAR AGENTS IN LUBRICANT COMPOSITIONS

RELATED APPLICATIONS

This application claims priority to and all the advantages of U.S. Provisional Patent Application Ser. No. 62/073,267, filed Oct. 31, 2014, and U.S. Provisional Patent Application Ser. No. 62/205,297, filed Aug. 14, 2015, which are expressly incorporated herein by reference in their entirety.

FIELD OF THE DISCLOSURE

The present disclosure generally relates to an additive package for a lubricant composition including an alkoxylated amide, an ester, and an anti-wear agent including phosphorus, molybdenum, or a combination thereof, a lubricant composition that includes a base oil, the alkoxylated amide, the ester, and the anti-wear agent including phosphorus, molybdenum, or a combination thereof, and to a method of lubricating an internal combustion engine with the lubricant composition that includes the alkoxylated amide, the ester, and the anti-wear agent including phosphorus, molybdenum, or a combination thereof.

BACKGROUND

Performance of lubricant compositions can be improved through the use of additives. For example, certain anti-wear agents have been added to lubricant compositions in order to reduce wear and increase fuel economy. However, further improvements in fuel economy are desired.

It is an object of the present disclosure to provide a combination of additives that improves the wear properties and the fuel economy of an internal combustion engine lubricated with the lubricant composition.

SUMMARY OF THE DISCLOSURE

The present disclosure provides an additive package for a lubricant composition. The additive package includes:

(A) an alkoxylated amide having a general formula (I):

(I)

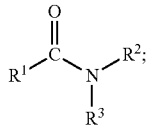

(B) an ester having a general formula (II):

(II)

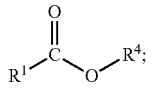

wherein each $R^1$, $R^2$, $R^3$, and $R^4$ is, independently, a linear or branched, saturated or unsaturated, hydrocarbyl group, at least one of $R^2$ and $R^3$ includes an alkoxy group, and $R^4$ includes an amine group; and (C) an anti-wear agent including phosphorus, molybdenum, or a combination thereof.

The present disclosure also provides a lubricant composition including a base oil, the alkoxylated amide having a general formula (I), the ester having a general formula (II), and the anti-wear agent including phosphorus, molybdenum, or a combination thereof. The present disclosure further provides a method of lubricating an internal combustion engine for improving fuel economy. The method includes providing the lubricant composition and lubricating the internal combustion engine with the lubricant composition.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE DISCLOSURE

Figure 1:
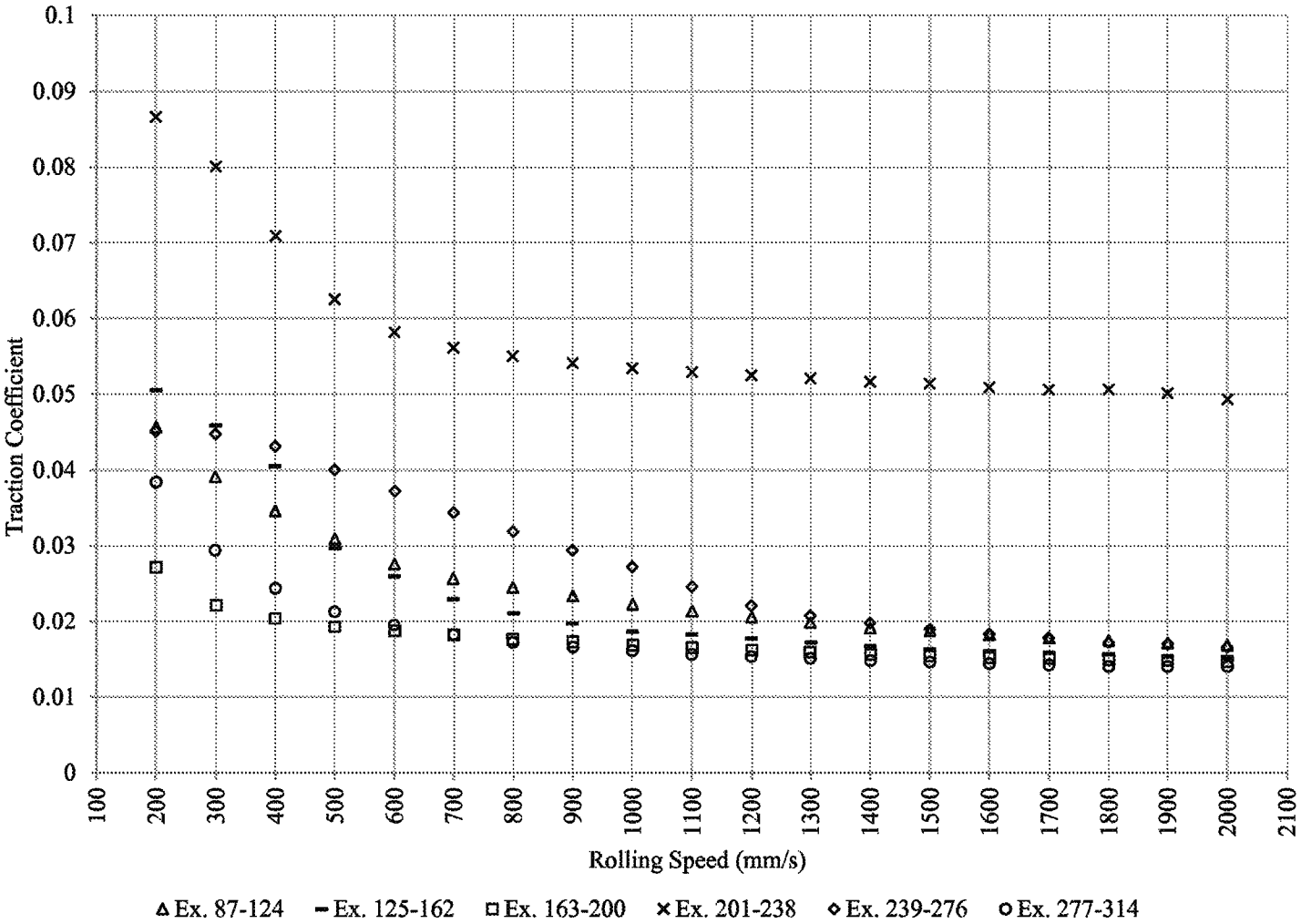
FIG. 1 is a graphical representation of a traction coefficient evaluation of one embodiment of a lubricant composition.

The present disclosure provides an additive package for a lubricant composition. The additive package or the lubricant composition includes an alkoxylated amide, an ester, and an anti-wear agent including phosphorus, molybdenum, or a combination thereof. The lubricant composition also includes a base oil. The additive package may be added to lubricant compositions. Both the additive package and the resultant lubricant composition (upon addition of the additive package) are contemplated and described collectively in this disclosure. It is to be appreciated that most references to the additive package throughout this disclosure also apply to the description of the lubricant composition. For example, it is to be appreciated that the lubricant composition may include, or exclude, the same components as the additive package, albeit in different amounts.

The alkoxylated amide has the following general formula (I):

(I)

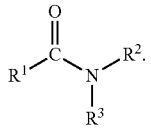

In general formula (I), each $R^1$, $R^2$, and $R^3$, is, independently, a linear or branched, saturated or unsaturated, hydrocarbyl group.

The ester has the following general formula (II):

(II)

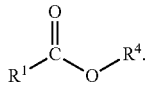

In general formula (II), each $R^1$ and $R^4$, is, independently, a linear or branched, saturated or unsaturated, hydrocarbyl group. It is to be appreciated that the hydrocarbyl group $R^1$ of the alkoxylated amide may be the same or different than the hydrocarbyl group $R^1$ of the ester.

As referred to herein, the hydrocarbyl groups of $R^1$, $R^2$, $R^3$, and $R^4$ are each, independently, a monovalent organic radical which includes, but is not limited to, hydrogen and carbon atoms. Each hydrocarbyl group designated by $R^1$, $R^2$, $R^3$, and $R^4$ may be, independently, linear or branched. Each hydrocarbyl group may be, independently, aromatic, aliphatic, or alicyclic. Each hydrocarbyl group may be, independently, saturated or ethylenically unsaturated. Each hydrocarbyl group may, independently, include an alkyl, alkenyl, cycloalkyl, cycloalkenyl, aryl, alkylaryl, arylalkyl group, or combinations thereof. Each hydrocarbyl group designated by $R^1$, $R^2$, $R^3$, and $R^4$ may, independently, include from 1 to 100, 1 to 50, 1 to 40, 1 to 30, 1 to 20, 1 to 17, 1 to 15, 1 to 10, 1 to 6, or 1 to 4, carbon atoms. Alternatively, each hydrocarbyl groups designated by $R^1$, $R^2$, $R^3$, and $R^4$ may, independently, include less than 20, less than 15, less than 12, or less than 10, carbon atoms.

Exemplary alkyl groups include methyl, ethyl, propyl, isopropyl, n-butyl, isobutyl, sec-butyl, tert-butyl, pentyl, iso-amyl, hexyl, 2-ethylhexyl, octyl, cetyl, 3,5,5-trimethylhexyl, 2,5,9-trimethyldecyl, hendeyl, and dodecyl groups. Exemplary cycloalkyl groups cyclopropyl, cyclopentyl and cyclohexyl groups. Exemplary aryl groups include phenyl and naphthalenyl groups. Exemplary arylalkyl groups include benzyl, phenylethyl, and (2-naphthyl)-methyl.

The hydrocarbyl groups designated by $R^1$, $R^2$, $R^3$, and $R^4$ may be, independently, unsubstituted or substituted. By "unsubstituted," it is intended that the designated hydrocarbyl group, $R^1$ for example, is free from substituent functional groups, such as alkoxy, amide, amine, keto, hydroxyl, carboxyl, oxide, thio, and/or thiol groups, and that the designated hydrocarbyl group or hydrocarbon group is free from heteroatoms and/or heterogroups.

In some embodiments, the hydrocarbyl groups of $R^1$, $R^2$, $R^3$, and $R^4$ are, independently, free from, or includes a limited number of certain substituent groups. For example, $R^1$, $R^2$, $R^3$, and $R^4$ may, independently, include fewer than three, fewer than two, one, or be completely free from, carbonyl groups. In other aspects, the hydrocarbyl groups of $R^1$, $R^2$, $R^3$, and $R^4$ are, independently, free from an estolide groups (and is not an estolide). In still other aspects, the hydrocarbyl groups of $R^1$, $R^2$, $R^3$, and $R^4$ may be, independently, free from metal ions and/or other ions.

In certain aspects, each hydrocarbyl group designated by $R^1$, $R^2$, $R^3$, and $R^4$ may be, independently, substituted, and include at least one heteroatom, such as oxygen, nitrogen, sulfur, chlorine, fluorine, bromine, or iodine, and/or at least one heterogroup, such as pyridyl, furyl, thienyl, and imidazolyl. Alternatively, or in addition to including heteroatoms and heterogroups, each hydrocarbyl group designated by $R^1$, $R^2$, $R^3$, and $R^4$ may, independently, include at least one substituent group selected from alkoxy, amide, amine, carboxyl, cyano, epoxy, ester, ether, hydroxyl, keto, sulfonate, sulfuryl, and thiol groups.

In certain embodiments, the alkoxylated amide having general formula (I), $R^1$ may include from 1 to 40, 3 to 35, 5 to 30, 6 to 25, 7 to 23, 8 to 16, or 9 to 13, carbon atom(s). In some embodiments, $R^1$ is a linear or branched, saturated or unsaturated, $C_7$-$C_{23}$ aliphatic hydrocarbyl group which optionally includes a hydroxyl group.

In general formula (I), at least one of $R^2$ and $R^3$ includes an alkoxy group. As referred to herein, an alkoxy group is defined as an alkyl group singularly bonded to an oxygen atom. The alkoxy group may be linear or branched. Non-limiting examples of suitable alkoxy groups include ethoxy, propoxy, and butoxy groups. At least one of $R^2$ and $R^3$ may include, independently, 1, 2, 3, 4, 5, 6, 7, 8, 9, 10 or more alkoxy group(s). As one example, $R^2$ may include 2 alkoxy groups and $R^3$ may include 3 alkoxy groups. As another example, $R^2$ may be free from alkoxy groups and $R^3$ may include 3 alkoxy groups. As a further example, $R^2$ may include 2 alkoxy groups and $R^3$ may include 2 alkoxy groups.

In certain embodiments, $R^2$ includes a propoxy group, a butoxy group, or a combination thereof. In other embodiments, $R^3$ includes a propoxy group, a butoxy group, or a combination thereof. In some embodiments, both $R^2$ and $R^3$ include a propoxy group, a butoxy group, or a combination thereof.

$R^2$ of the alkoxylated amide may have a general formula (III):

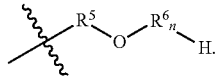

(III)

In general formula (III), $R^5$ is an alkyl group, each $R^6$ is an alkoxy group, and n is an integer from 0 to 5.

In general formula (III), the alkyl group of $R^5$ may include from 1 to 25, 1 to 15, 1 to 10, 1 to 8, 1 to 6, 1 to 4, or 2 to 3, carbon atom(s). The alkyl group may be linear or branched. In certain embodiments, the alkyl group of $R^5$ is an ethyl group or a propyl group.

In general formula (III), each alkoxy group of $R^6_n$ may independently be an ethoxy group, a propoxy group, or a butoxy group such that $R^2$ of the alkoxylated amide may include an ethoxy group, propoxy group, butoxy group, or combinations thereof. In certain embodiments, each alkoxy group of $R^6_n$ is, independently, a propoxy group or a butoxy group. For example, in embodiments wherein n of $R^6_n$ is 2, $R^6_n$ may include two propoxy groups, two butoxy groups, or one propoxy group and one butoxy group.

In various embodiments, $R^3$ of the alkoxylated amide is a hydrocarbyl group having a general formula (IV):

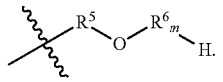

(IV)

In general formula (IV), $R^5$ is an alkyl group, each $R^6$ is an alkoxy group, and m is an integer from 0 to 5.

In general formula (IV), the alkyl group of $R^5$ may include from 1 to 25, 1 to 15, 1 to 10, 1 to 8, 1 to 6, 1 to 4, or 2 to 3, carbon atom(s). The alkyl group may be linear or branched. In certain embodiments, the alkyl group of $R^5$ is an ethyl group or a propyl group.

In general formula (IV), each alkoxy group of $R^6_m$ may independently be an ethoxy group, a propoxy group, or a butoxy groups such that $R^3$ of the alkoxylated amide may include one or more ethoxy groups, propoxy groups, butoxy groups, or combinations thereof. In certain embodiments, each alkoxy group of $R^6_m$ is, independently, a propoxy group or a butoxy group.

For example, in these certain embodiments wherein m of $R^6_m$ is 2, $R^6_m$ may include two propoxy groups, two butoxy groups, or one propoxy group and one butoxy group.

With regard to general formulas (III) and (IV), in some embodiments, $1 \leq (n+m) \leq 5$. In other words, n+m has a sum of from 1 to 5. Alternatively, $1 \leq (n+m) \leq 3$, $1 \leq (n+m) \leq 2$, or n+m=1.

In certain embodiments, the alkoxylated amide having general formula (I) is further defined as having a general formula (VIII):

$$R^1—C(=O)—N[R^5—O—R^6_n—H][R^5—O—R^6_m—H] \quad \text{(VIII).}$$

In general formula (VIII), in certain embodiments, $R^1$ is a linear or branched, saturated or unsaturated, $C_7$-$C_{23}$ aliphatic hydrocarbyl group, $R^5$ is an alkyl group, $R^6$ is an alkoxy group, n is an integer from 0 to 5, and m is an integer from 0 to 5. In general formula (VIII), in certain embodiments, $1 \leq (n+m) \leq 5$. In one embodiment, each alkyl group of $R^5$ is, independently, an ethyl group or a propyl group, and each alkoxy group of $R^6_n$ and $R^6_m$ is, independently, a propoxy group or a butoxy group. Non-limiting examples of suitable alkoxy groups designated by $R^6$ include:

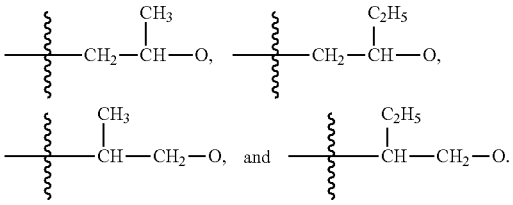

The alkoxylated amide, such as the alkoxylated amide of general formula (I), may be present in the additive package in an amount of from 0.01 to 75, 0.01 to 50, 0.01 to 25, 0.1 to 15, 0.5 to 10, or 1 to 5, wt. %, based on the total weight of the additive package. Alternatively, the alkoxylated amide may be present in amounts of less than 75, less than 50, less than 25, less than 15, less than 10, or less than 5, wt. %, based on the total weight of the additive package.

The alkoxylated amide may be present in the lubricant composition in an amount of from 0.01 to 20, 0.05 to 15, 0.1 to 10, 0.1 to 5, 0.1 to 2, 0.1 to 1, or 0.1 to 0.5, wt. %, based on the total weight of the lubricant composition. Alternatively, the alkoxylated amide may be present in the lubricant composition in an amount of from 0.01 to 20, 0.01 to 15, 0.01 to 10, 0.01 to 5, 0.01 to 2, 0.01 to 1, or 0.01 to 0.5, wt. %, based on the total weight of the lubricant composition.

Alternatively, the alkoxylated amide may be present in amounts of less than 20, less than 15, less than 10, less than 5, less than 2, less than 1, or less than 0.5, wt. %, based on the total weight of the lubricant composition.

Referring specifically to the ester having general formula (II), $R^1$, of general formula (II), may include from 1 to 40, 3 to 35, 5 to 30, 6 to 25, 7 to 23, 8 to 16, or 9 to 13, carbon atoms. In some embodiments, $R^1$ is a linear or branched, saturated or unsaturated, $C_7$-$C_{23}$ aliphatic hydrocarbyl group. $R^1$ may include a hydroxyl group.

$R^4$, of general formula (II), includes an amine group. The amine group may be a primary, secondary, or tertiary amine. In some embodiments, the amine group is alkoxylated.

In certain embodiments, $R^4$ of the ester of general formula (II) has a general formula (V):

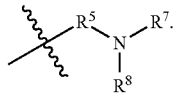

(V)

In general formula (V), $R^5$ is an alkyl group, and each $R^7$ and $R^8$ is, independently, a linear or branched, saturated or unsaturated, hydrocarbyl group. In general formula (V), the alkyl group of $R^5$ may include from 1 to 25, 1 to 15, 1 to 10, 1 to 8, 1 to 6, 1 to 4, or 2 to 3, carbon atom(s). The alkyl group may be linear or branched. In certain embodiments, the alkyl group of $R^5$ is an ethyl group or a propyl group.

In general formula (V), at least one of $R^7$ and $R^8$ includes an alkoxy group. In certain embodiments, $R^7$ includes a propoxy group, a butoxy group, or a combination thereof. In other embodiments, $R^8$ includes a propoxy group, a butoxy group, or a combination thereof. In some embodiments, both $R^7$ and $R^8$ include a propoxy group, a butoxy group, or a combination thereof.

In various embodiments, $R^7$ is a hydrocarbyl group having a general formula (VI):

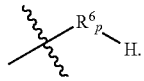

(VI)

In general formula (VI), $R^6$ is an alkoxy group, and p is an integer from 0 to 5. In general formula (VI), each alkoxy group of $R^6_p$ may independently be an ethoxy group, a propoxy group, or a butoxy group. In certain embodiments, the alkoxy group of $R^6_p$ is, independently, a propoxy group or a butoxy group. For example, in embodiments wherein p of $R^6_p$ is 2, $R^6_p$ may include two propoxy groups, two butoxy groups, or one propoxy group and one butoxy group.

In various embodiments, $R^8$ is a hydrocarbyl group having a general formula (VII):

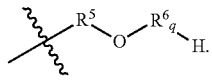

(VII)

In general formula (VII), $R^5$ is an alkyl group, $R^6$ is an alkoxy group, and q is an integer from 0 to 5.

In general formula (VII), the alkyl group of $R^5$ may include from 1 to 25, 1 to 15, 1 to 10, 1 to 8, 1 to 6, 1 to 4, or 2 to 3, carbon atom(s). The alkyl group may be linear or branched. In certain embodiments, the alkyl group of $R^5$ is an ethyl group or a propyl group.

In general formula (VII), each alkoxy group of $R^6_q$ may independently be an ethoxy group, a propoxy group, or a butoxy group. In certain embodiments, each alkoxy group of $R^6_q$ is, independently, a propoxy group or a butoxy group. For example, in embodiments wherein q of $R^6_q$ is 2, $R^6_q$ may include two propoxy groups, two butoxy groups, or one propoxy group and one butoxy group.

With regard to general formulas (VI) and (VII), in certain embodiments, if q is 0, p is an integer from 0 to 5. If q is >0, p is an integer from 1 to 5. In some embodiments, $0 \leq (p+q) \leq 5$. In other words, p+q has a sum of from 0 to 5. Alternatively, $0 \leq (p+q) \leq 3$, $1 \leq (p+q) \leq 2$, or p+q=1. In some embodiments, p is 0 to 3 and q is 0, or p is 1 to 3 and q is 0. For example, in one exemplary embodiment, q is 0 and p is 3 and in another exemplary embodiment, q=0 and p=0.

In certain embodiments, the ester having general formula (II) is further defined as having a general formula (IX):

$$R^1—C(=O)—O—R^5—N[R^5—O—R^6{}_q—H][R^6{}_p—H] \quad \text{(IX).}$$

In general formula (IX), in certain embodiments, $R^1$ is a linear or branched, saturated or unsaturated, $C_7$-$C_{23}$ aliphatic hydrocarbyl group, $R^5$ is an alkyl group, $R^6$ is an alkoxy group, q is an integer from 0 to 5, and p is an integer from 0 to 5. In general formula (IX), in certain embodiments, if q is 0, p is an integer from 0 to 5, if q is >0, p is an integer from 1 to 5, and $0 \leq (p+q) \leq 5$. In one embodiment, each alkyl group of $R^5$ is, independently, an ethyl group or a propyl group, and each alkoxy group of $R^6{}_q$ and $R^6{}_p$ is, independently, a propoxy group or a butoxy group. Non-limiting examples of suitable alkoxy groups designated by $R^6$ include:

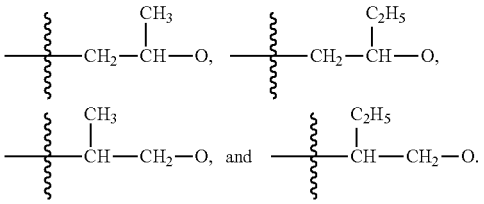

The ester, such as the ester of general formula (II), may be present in the additive package in an amount of from 0.01 to 75, 0.01 to 50, 0.01 to 25, 0.1 to 15, 0.5 to 10, or 1 to 5, wt. %, each based on the total weight of the additive package. Alternatively, the ester may be present in amounts of less than 75, less than 50, less than 25, less than 15, less than 10, or less than 5, wt. %, each based on the total weight of the additive package.

The ester may be present in the lubricant composition in an amount of from 0.01 to 20, 0.05 to 15, 0.05 to 10, 0.05 to 5, 0.05 to 2, 0.05 to 1, or 0.05 to 0.5, wt. %, based on the total weight of the lubricant composition. Alternatively, the ester may be present in the lubricant composition in an amount of from 0.01 to 20, 0.01 to 15, 0.01 to 10, 0.01 to 5, 0.01 to 2, 0.01 to 1, or 0.01 to 0.5, wt. %, based on the total weight of the lubricant composition. Alternatively, the ester may be present in amounts of less than 20, less than 15, less than 10, less than 5, less than 2, less than 1, or less than 0.5, wt. %, based on the total weight of the lubricant composition.

The additive package or the lubricant composition may include the alkoxylated amide and the ester in a weight ratio of less than 50:50, 40:60, 30:70, 25:75, 20:80, 15:85, 10:90, 5:95, 3:97, 2:98, 1:99, or 0.1:99.9, of the ester to the alkoxylated amide.

With regard to general formula (VIII) for the alkoxylated amide and general formula (IX) the ester, in certain embodiments, each $R^1$ is, independently, a linear or branched, saturated or unsaturated, $C_7$-$C_{23}$ aliphatic hydrocarbyl group. Further, in these embodiments, each $R^5$ is, independently, an ethyl group or a propyl group, and each $R^6$ is, independently, a propoxy group. Also, in these embodiments, n is an integer from 0 to 5, m is an integer from 0 to 5, and $1 \leq (n+m) \leq 5$. Moreover, in these embodiments, q is an integer from 0 to 5, if q is 0, p is an integer from 1 to 5, if q is >0, and p is an integer from 1 to 5, $1 \leq (p+q) \leq 5$. In these embodiments, the lubricant composition includes the alkoxylated amide and the ester in a weight ratio of less than 70:30 of the ester to the alkoxylated amide.

Exemplary alkoxylated amides include, but are not limited to:

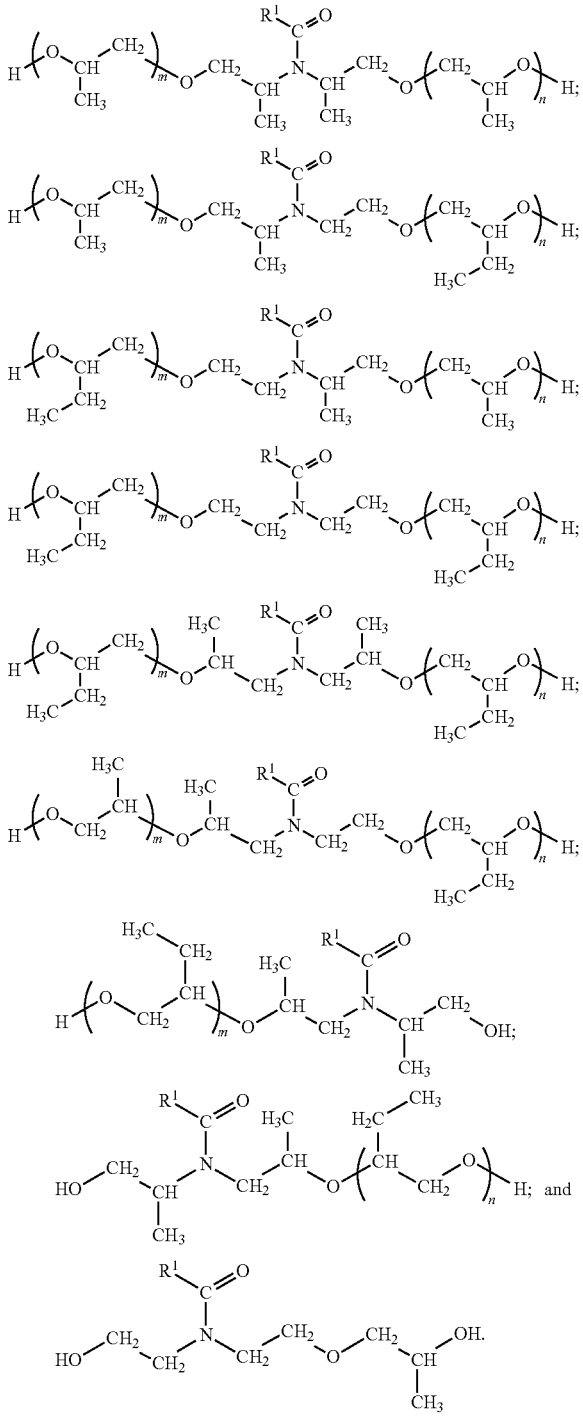

In these exemplary alkoxylated amides, $R^1$ is a linear or branched, saturated or unsaturated, hydrocarbyl group, n is an integer from 0 to 5, m is an integer from 0 to 5, and $1 \leq (n+m) \leq 5$.

Exemplary esters include, but are not limited to:

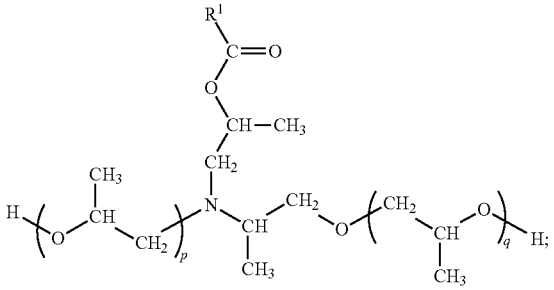

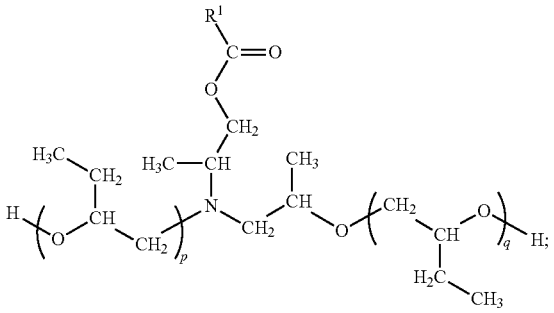

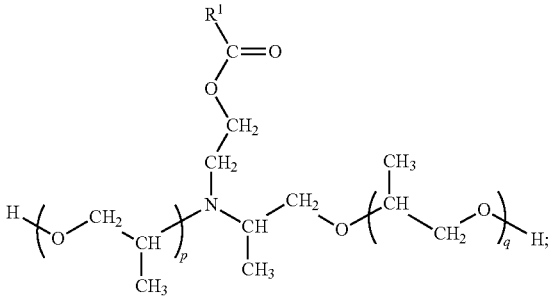

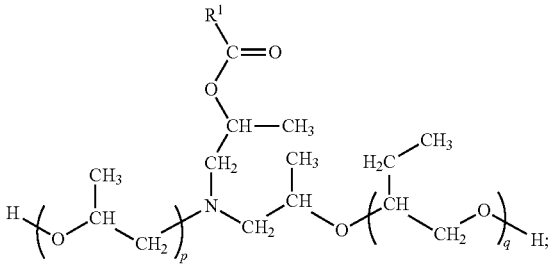

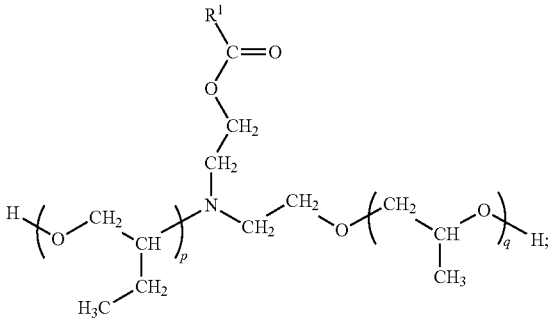

-continued

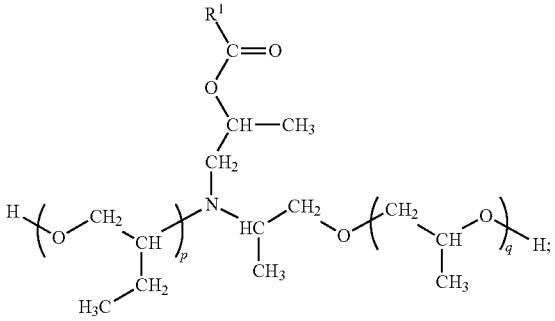

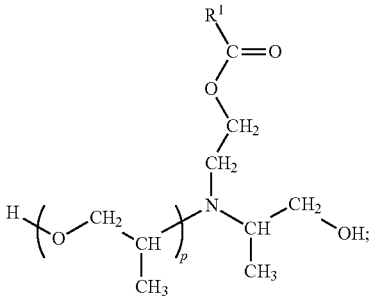

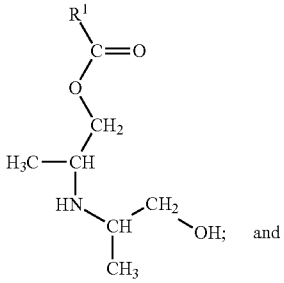

and

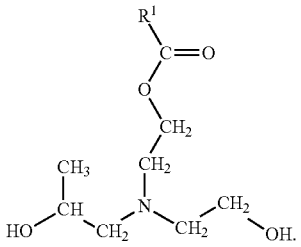

In these exemplary esters, $R^1$ is a linear or branched, saturated or unsaturated, hydrocarbyl group, q is an integer from 0 to 5, if q is 0, p is an integer from 0 to 5; if q is >0, p is an integer from 1 to 5, and $0 \leq (p+q) \leq 5$.

It should be appreciated that various mechanisms may be used to prepare the alkoxylated amide and the ester of the additive package or the lubricant composition. For example, in one embodiment, the alkoxylated amide and the ester may be prepared by reacting (a) at least one fatty acid, at least one fatty acid ester, or a mixture thereof, with (b) a dialkanolamide. In this embodiment, 1 mole of the amide and the ester resulting from steps (a) and (b) may then be reacted with from 1 to 5 moles of propylene oxide and/or butylene oxide to form the alkoxylated amide having general formula (I) and ester having general formula (II). In certain embodiments, the alkoxylated amide having general formula (I) and ester having general formula (II) are free of ethoxy groups which can result from alkoxylation with ethylene oxide.

Particularly, the alkoxylated amide having general formula (VIII) which further defines the alkoxylated amide having general formula (I) and the ester having general formula (IX) which further defines the ester having general formula (II) may be prepared by first reacting at least one fatty acid and/or at least one fatty acid ester with a dialkanolamine to form a dialkanolamide having general formula (X) and ester having general formula (XI), as shown below. Next, 1 mole of the dialkanolamide having general formula (X) and ester having general formula (XI) may be reacted with 1 to 5 moles of propylene oxide and/or butylene oxide to form the alkoxylated amide having general formula (VIII) and ester having general formula (IX). In certain embodiments, the alkoxylated amide having general formula (VIII) and ester having general formula (IX) are free of ethoxy groups which can result from alkoxylation with ethylene oxide. The major product is the alkoxylated amide having general formula (VIII), with the ester of general formula (IX) being present in an amount of up to 50, 40, 30, 20, 15, 10, 5, 3, 2, 1, or 0.1, wt. %, by total weight of the alkoxylated amide having general formula (VIII) and ester having general formula (IX).

The alkoxylated amide having general formula (VIII) and ester having general formula (IX) may be formed as follows:

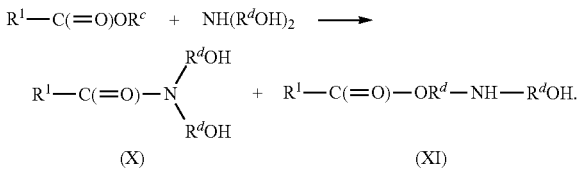

$R^1$ is a linear or branched, saturated or unsaturated, hydrocarbyl group. $R^c$ is hydrogen or $C_{1-3}$ alkyl, and $R^d$ is an alkylene group containing 2 or 3 carbon atoms. If $R^c$ is $C_{1-3}$ alkyl, the $R^cOH$ by-product can remain in the reaction mixture (not shown). Optionally, the $R^cOH$ by-product can be removed from the reaction mixture. The amide having general formula (X) and ester having general formula (XI) may then be reacted with propylene oxide and/or butylene oxide to provide the alkoxylated amide having general formula (VIII) and ester having general formula (IX).

Alternatively, the alkoxylated amide having general formula (VIII) can be prepared from a vegetable oil, animal oil, or triglyceride as follows:

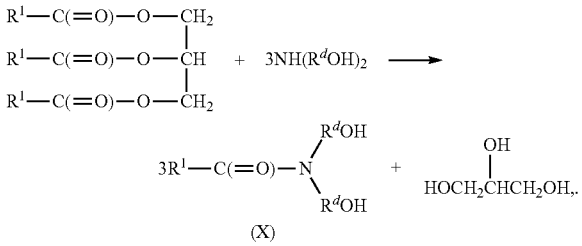

$R^1$ is a linear or branched, saturated or unsaturated, hydrocarbyl group. $R^d$ is an alkylene group containing 2 or 3 carbon atoms. The amide having general formula (X) may be reacted with propylene oxide and/or butylene oxide. In certain embodiments, the propoxylation/butoxylation is the presence of the glycerin by-product. In other embodiments, the propoxylation/butoxylation is after separation of the amide having general formula (X) from the glycerin by-product. It is to be appreciated that the ester having general formula (XI) is formed and, after propoxylation/butoxylation, the ester having general formula (IX) is also formed.

The fatty acid and/or fatty acid ester used in the reaction to form the amide contains from 2 to 24 carbon atoms, from 2 to 20 carbon atoms, or from 8 to 18 carbon atoms. The fatty acid and/or fatty acid ester therefore can be, but not limited to, lauric acid, myristic acid, palmitic acid, stearic acid, octanoic acid, pelargonic acid, behenic acid, cerotic acid, monotanic acid, lignoceric acid, doeglic acid, erucic acid, linoleic acid, isanic acid, stearodonic acid, arachidonic acid, chypanodoic acid, ricinoleic acid, capric acid, decanoic acid, isostearic acid, gadoleic acid, myristoleic acid, palmitoleic acid, linderic acid, oleic acid, petroselenic acid, esters thereof, or combinations thereof. In certain embodiments, the fatty acid/fatty acid ester includes lauric acid, or a compound having a lauric acid residue, e.g., coconut oil.

The fatty acid/fatty acid ester also can be derived from a vegetable oil or an animal oil, for example, but not limited to, coconut oil, babassu oil, palm kernel oil, palm oil, olive oil, castor oil, peanut oil, jojoba oil, soy oil, sunflower seed oil, walnut oil, sesame seed oil, rapeseed oil, rape oil, beef tallow, lard, whale blubber, seal oil, dolphin oil, cod liver oil, corn oil, tall oil, cottonseed oil, or combinations thereof. The vegetable oils contain a mixture of fatty acids. For example, coconut oil may contain the following fatty acids: caprylic (8%), capric (7%), lauric (48%), myristic (17.5%), palmitic (8.2%), stearic (2%), oleic (6%), and linoleic (2.5%).

The fatty acid/fatty acid ester can also be derived from fatty acid esters, such as, for example, glyceryl trilaurate, glyceryl tristearate, glyceryl tripalmitate, glyceryl dilaurate, glyceryl monostearate, ethylene glycol dilaurate, pentaerythritol tetrastearate, pentaerythritol trilaurate, sorbitol monopalmitate, sorbitol pentastearate, propylene glycol monostearate, or combinations thereof.

The fatty acid/fatty acid ester may include one or more fatty acids, one or more fatty acid methyl ester, one or more fatty acid ethyl ester, one or more vegetable oil, one or more animal oil, or combinations thereof. The amide resulting from the reaction can contain by-products, such as glycerin, ethylene glycol, sorbitol, and other polyhydroxy compounds. In certain embodiments, the water, methanol, and/or ethanol by-products may be removed from the reaction to substantially reduce the amount of unwanted by-products. In some embodiments, the by-product polyhydroxy compounds are allowed to remain in the reaction mixture because these compounds may not adversely affect the alkoxylated amide having general formula (VIII). In certain embodiments, the by-products resulting from the reaction which remain in the reaction mixture may be included in the additive package or the lubricant composition.

The fatty acid/fatty acid ester is reacted with a dialkanolamine to provide an amide having general formula (X), such as dialkanolamide. Dialkanolamines contain a hydrogen atom for reaction with the carboxyl or ester group of the fatty acid/fatty acid ester. Dialkanolamines also contain two hydroxy groups for subsequent reaction with alkylene oxides, such as propylene oxide and/or butylene oxide. A portion of the dialkanolamine reacts with the fatty acid/fatty acid ester to provide the ester having general formula (XI) by reaction of a hydroxy group of the dialkanolamine with the fatty acid/fatty acid ester. The amino group of the dialkanolamine is available for a subsequent reaction with alkylene oxides, such as propylene oxide and/or butylene oxide to form the ester having general formula (XI). In some embodiments, dialkanolamines contain two or three carbons in each of the two alkanol groups, such as diethanolamine, di-isopropylamine, and di-n-propylamine. In one embodiment, the dialkanolamine is diethanolamine.

In a preparation of the alkoxylated amide having general formula (X) and ester having general formula (XI), the dialkanolamine can be present in an equivalent molar amount to the fatty acid residues in the fatty acid/fatty acid ester. In another embodiment, the dialkanolamine is present in a molar amount different from the moles of fatty acid residues, i.e., a molar excess or deficiency. In one embodiment, the number of moles of dialkanolamine is substantially equivalent to the number of moles of fatty acid residue. As used herein, the term "fatty acid residue" is defined as $R^1$—C(=O). Therefore, a methyl ester of a fatty acid, i.e., $R^1$—C(=O)$OCH_3$, contains one fatty acid residue, and the method may utilize a substantially equivalent number of moles of dialkanolamine to methyl ester. A triglyceride contains three fatty acid residues, and the method may utilize about three moles of dialkanolamine per mole of triglyceride. The mole ratio of dialkanolamine to fatty acid residue may be from 0.3 to 1.5, from 0.6 to 1.3, from 0.8 to 1.2, or from 0.9 to 1.1 moles per mole of fatty acid residue.

The reaction to prepare the amide having formula general (X) and the ester having general formula (XI) can be performed in the presence or absence of a catalyst. In certain embodiments, a basic catalyst is employed. In one embodiment, a catalyst can be an alkali metal alcoholate, such as sodium methylate, sodium ethylate, potassium methylate, or potassium ethylate. Alkali metal hydroxides, such as sodium or potassium hydroxide acid, and alkali metal carbonates, such as sodium carbonate or potassium carbonate, also can be used as the catalyst.

If employed, the catalyst may be present in an amount of from 0.01 to 5, 0.05 to 4, 0.1 to 3, or 0.5 to 2, wt. %, based on the total weight of the amide having formula (X) and the ester having formula (XI) to be produced. The reaction temperature to form the amide having formula (X) and the ester having formula (XI) may be from 50° C. to about 200° C. The reaction temperature may be higher than the boiling point of an alcohol, e.g., methanol, and/or water produced during the reaction to eliminate water and/or the alcohol as it is generated in the reaction. The reaction may be performed for from 2 to 24 hours.

Depending on the starting materials, the final reaction mixture in the preparation of the amide having general formula (X) and the ester having general formula (XI) may contain by-product compounds. These compounds can include, for example: (i) a by-product hydroxy compound, e.g., glycerin or other alcohol; (ii) a by-product mono-ester of a triglyceride, e.g., glyceryl mono-cocoate, (iii) a by-product di-ester of a triglyceride, e.g., glyceryl di-cocoate; and (iv) a dialkanolamine, if an excess molar amount of dialkanolamine is employed. The reaction mixture contains the ester having general formula (XI) wherein one or more of the hydroxy groups of the dialkanolamine reacts with the acid, and also can contain ester-amides wherein both ester and amide groups are formed. In certain embodiments, such by-product compounds are allowed to remain in the final reaction mixture containing the alkoxylated amide having general formula (VIII) and the ester having general formula (IX). As a result, in certain embodiments, the by-product compounds that remain in the final reaction mixture may be included in the additive package or the lubricant composition. In other embodiments, the by-product compounds that remain in the final reaction mixture may be excluded from the additive package or the lubricant composition.

After the amide having general formula (X) and the ester having general formula (XI) are formed, by-products optionally can be separated therefrom. For example, if a vegetable oil is used as the starting material for the fatty acid residues, the glycerin by-product can be removed from the reaction mixture. In certain embodiments, the reaction mixture including the amide having general formula (X) and the ester having general formula (XI) is used without further purification, except for the removal of solvents, water, and/or low molecular weight alcohols, e.g., methanol and ethanol. To avoid the generation of a glycerin by-product a fatty acid or a fatty acid methyl ester can be used as the fatty acid residue source.

After formation of the amide having general formula (X) and the ester having general formula (XI), 1 mole of the amide and ester (in total) is reacted with from 1 to 5 or from 1 to 3, total moles of alkylene oxide, such as propylene oxide and/or butylene oxide. In this step, the amide and ester can be reacted with propylene oxide first, then with butylenes oxide; or with butylenes oxide first, then with propylene oxide; or with propylene oxide and butylene oxide simultaneously. The amide having general formula (X) and the ester having general formula (XI) also can be solely reacted with propylene oxide or solely be reacted with butylene oxide. In certain embodiments, 1 mole of the amide having general formula (X) and the ester having general formula (XI), in total, is solely reacted with about 1 to about 3 moles of propylene oxide.

The propoxylation/butoxylation reaction often is performed under basic conditions, for example by employing a basic catalyst of the type used in the preparation of the amide having general formula (X) and the ester having general formula (XI). Additional basic catalysts are nitrogen-containing catalysts, for example, an imidazole, N—N-dimethylethanolamine, and N,N-dimethylbenzylamine. It also is possible to perform the alkoxylation reaction in the presence of a Lewis acid, such as titanium trichloride or boron trifluoride. If employed, the amount of catalyst utilized is from 0.5% to 0.7%, by weight, based on the amount of the amide having general formula (X) and the ester having general formula (XI), in total, used in the alkoxylation reaction. In some embodiments, a catalyst is omitted from the reaction.

The temperature of the alkoxylation reaction may be from 80° C. to 180° C. The alkoxylation reaction may be performed in an atmosphere that is inert under the reaction conditions, e.g., nitrogen.

The alkoxylation reaction also can be performed in the presence of a solvent. The solvent may be inert under the reaction conditions. Suitable solvents are aromatic or aliphatic hydrocarbon solvents, such as hexane, toluene, and xylene. Halogenated solvents, such as chloroform, or ether solvents, such as dibutyl ether and tetrahydrofuran, also can be used.

In various embodiments, the reaction mixture that yields the amide having general formula (X) and the ester having general formula (XI) is used without purification in the alkoxylation reaction to provide the alkoxylated amide having general formula (VIII) and the ester having general formula (IX). In other embodiments, the reaction mixture that provides the alkoxylated amide having general formula (VIII) and the ester having general formula (IX) also is used without purification. As a result, the reaction product may include a variety of products and by-product compounds including, for example, alkoxylated amide having general formula (VIII), the ester having general formula (IX), the amide having general formula (X), the ester having general formula (XI), unreacted dialkanolamine, by-product hydroxy compounds (e.g., glycerin or other alcohol), monoand/or di-esters of a starting triglyceride, polyalkylene oxide oligomers, aminoesters, and ester-amides. As a result, in certain embodiments, the by-product compounds that remain in the reaction mixture with the products may be included in the additive package or the lubricant composition. In other embodiments, the by-product compounds that remain in the reaction mixture may be excluded from the additive package or the lubricant composition.

It also should be understood that the propoxylation/butoxylation reaction may yield a mixture of the alkoxylated amide having general formula (VIII) and the ester having general formula (IX). In particular, both $CH_2CH_2OH$ groups of the amide having general formula (X) can be alkoxylated, either to a different degree (i.e., n>0, m>0, and n≠m) or to the same degree (i.e., n>0, m>0, and n=m). In certain embodiments, only one $CH_2CH_2OH$ of the amide having general formula (X) is alkoxylated (i.e., one of n or m is 0). In other embodiments, the amide having general formula (X), such as dialkanolamide, is alkoxylated with one mole of alkylene oxide and one mole of propylene oxide. It is to be appreciated that a portion of the amide having general formula (X) will not be alkoxylated, thus n+m can be less than 1, i.e., a lower limit of 0.5.

In certain embodiments, the alkoxylated amide and the ester are utilized as a fuel economy agent in the lubricant composition. Fuel economy agents may be utilized in mixed and boundary lubricant applications to reduce the friction coefficient of the lubricant composition. Specifically, without intending to be bound by theory, in an engine, it is contemplated that the fuel economy agent may absorb onto metal surfaces of the engine to form a monolayer. It is believed that this monolayer may decrease direct metal-to-metal contacts in the engine when utilized in mixed and boundary lubricant applications. This decrease of metal-to-metal contacts may reduce wear of the engine. In lubricant compositions including the anti-wear agent, it is also believed that the fuel economy agent absorbs onto a layer of the anti-wear agent that is present on metal surfaces of the engine, such as a tribofilm, to reduce the friction coefficient of the layer of the anti-wear agent present on the surface of the engine.

With regard to the anti-wear agent of the additive package or the lubricant composition introduced above, the anti-wear agent includes phosphorus, molybdenum, or a combination thereof. In certain embodiments, the additive package or the lubricant composition may include an anti-wear agent including phosphorus. The anti-wear agent including phosphorus may be exemplified by a dihydrocarbyl dithiophosphate salt. The dihydrocarbyl dithiophosphate salt may be represented by the following general formula (XII):

$$[R^9O(R^{10}O)PS(S)]_2M \qquad \text{(XII).}$$

In general formula (XII), $R^9$ and $R^{10}$ are each hydrocarbyl groups, independently, having from 1 to 30, 1 to 20, 1 to 15, 1 to 10, or 1 to 5, carbon atoms. Furthermore, in general formula (XII), M is a metal atom or an ammonium group. For example, $R^9$ and $R^{10}$ may each independently be $C_{1-20}$ alkyl groups, $C_{2-20}$ alkenyl groups, $C_{3-20}$ cycloalkyl groups, $C_{1-20}$ aralkyl groups or $C_{3-20}$ aryl groups. The groups designated by $R^9$ and $R^{10}$ may be substituted or unsubstituted. The metal atom may be selected from the group including aluminum, lead, tin, manganese, cobalt, nickel, or zinc. The ammonium group may be derived from ammonia or a primary, secondary, or tertiary amine. The ammonium group may be of the formula $R^{11}R^{12}R^{13}R^{14}N^+$, wherein $R^{11}$, $R^{12}$, $R^{13}$, and $R^{14}$ each independently represents a hydrogen atom or a hydrocarbyl group having from 1 to 150 carbon atoms. In certain embodiments, $R^{11}$, $R^{12}$, $R^{13}$, and $R^{14}$ may each independently be hydrocarbyl groups having from 4 to 30 carbon atoms. In one embodiment, the dihydrocarbyl dithiophosphate salt is zinc dialkyl dithiophosphate (ZDDP). The lubricant composition may include mixtures of different dihydrocarbyl dithiophosphate salts. In some embodiments, the anti-wear agent may be ashless.

In certain embodiments, the dihydrocarbyl dithiophosphate salt includes a mixture of primary and secondary alkyl groups for, $R^9$ and $R^{10}$, wherein the secondary alkyl groups are in a major molar proportion, such as at least 60, at least 75, or at least 85, mole %, based on the number of moles of alkyl groups in the dihydrocarbyl dithiophosphate salt. In these embodiments, the dihydrocarbyl dithiophosphate salt may include primary alkyl groups and secondary alkyl groups. In general, ZDDP may be formed by reacting alcohols with thiophosphates. ZDDP is generally described by the alcohol that is used in the synthesis process to donate the alkyl groups to the ZDDP molecule. So for instance, a "primary" ZDDP is formed from primary alcohols including, but not limited to, n-decanol, n-octanol, 2-ethyl-1-hexanol, 1-hexanol, 4-methyl-1-pentanol, 2-methyl-1-propanol, 1-pentanol, 1-butanol, 1-propanol and mixtures thereof. Similarly, a "secondary" ZDDP is formed from secondary alcohols including, but not limited to, 2-propanol, 2-butanol, 2-pentanol, 4-methyl-2-pentanol, 2-hexanol, 2-octanol and 2-decanol and mixtures thereof. An "aryl" ZDDP may include those formed from phenol, butylated phenol, 4-dodecyl phenol and 4-nonyl phenol, and combinations thereof.

The anti-wear agent may be further defined as a phosphate. In another embodiment, the anti-wear agent is further defined as a phosphite. In still another embodiment, the anti-wear agent is further defined as a phosphorothionate. The anti-wear agent may alternatively be further defined as a phosphorodithioate. In one embodiment, the anti-wear agent is further defined as a dithiophosphate. The anti-wear agent may also include an amine such as a secondary or tertiary amine. In one embodiment, the anti-wear agent includes an alkyl and/or dialkyl amine. The anti-wear agent may be acidic, basic, or neutral. Structures of suitable non-limiting examples of anti-wear agents are set forth immediately below:

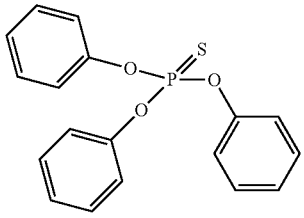

Triphenyl Phosphorothionate

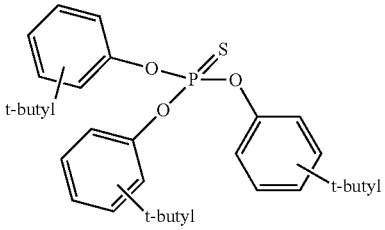

Butylated Triphenyl Phosphorothionate

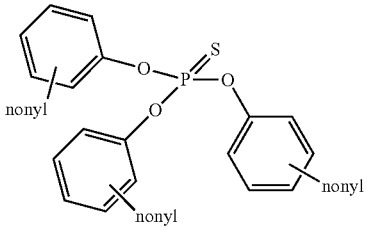

Nonyl Triphenyl Phosphorothionate

-continued

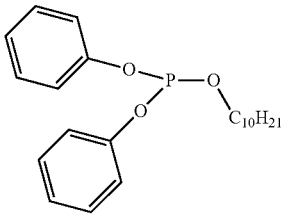

Decyl Diphenylphosphite

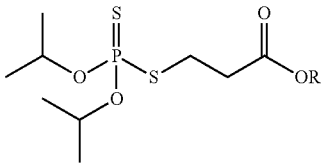

Neutral Dialkyl Dithiophosphate

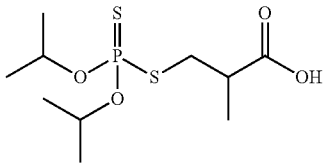

Acidic Dialkyl Dithiophosphate

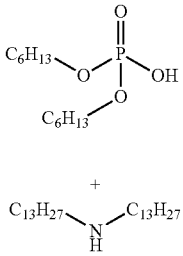

Amine Phosphate + Ditridecyl Amine

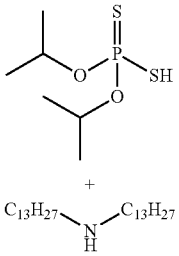

Isopropyl Phosphorodithioate + Ditridecyl Amine

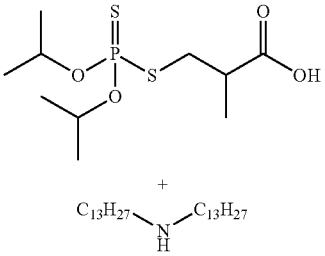

Acidic Dialkyl Dithiophosphate + Ditridecyl Amine

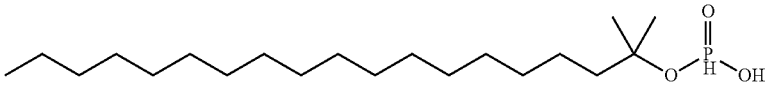

Dimethyloctadecyl Phosphonate

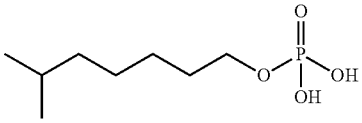

Iso-Octyl Phosphate + $C_{12}$-$C_{14}$ Amine

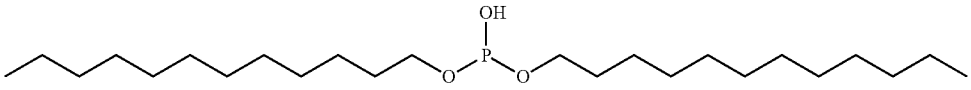

Dilauryl Hydrogen Phosphite

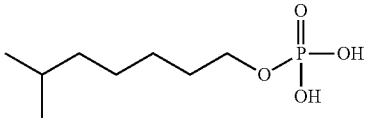

Iso-Octyl Phosphate + $C_{12}$-$C_{14}$ Amine

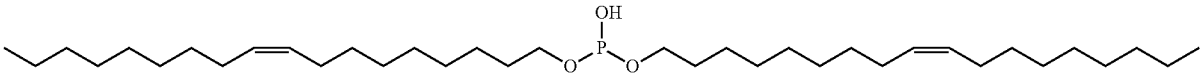

Dioleyl Hydrogen Phosphite

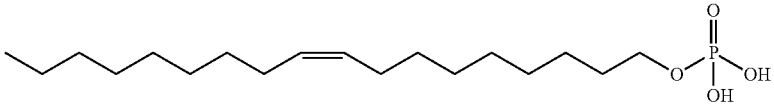

Oleyl Phosphate

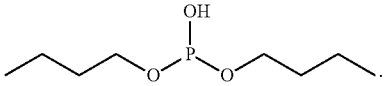

Dibutyl Hydrogen Phosphite

In other embodiments, the anti-wear agent may include molybdenum. For example, the anti-wear agent including molybdenum may be exemplified by any suitable oil-soluble organo-molybdenum compound. Typically, the anti-wear agent including molybdenum includes a molybdenum-sulfur core formed from one or more molybdenum atoms and one or more sulfur atoms. Non-limiting examples of suitable anti-wear agents including molybdenum include molybdenum dithiocarbamates, molybdenum dithiophosphates, molybdenum dialkyldithiophosphates, molybdenum dithiophosphinates, molybdenum xanthates, molybdenum alkyl xanthates, molybdenum alkylthioxanthates, molybdenum thioxanthates, molybdenum sulfides, and combinations thereof.

In certain embodiments, the anti-wear agent including molybdenum is dinuclear or trinuclear. In one embodiment, the anti-wear agent including molybdenum is a tri-nuclear molybdenum compound that may be represented by the following general formula (XIII):

$$MO_3S_kL_nQ_z \quad \text{(XIII).}$$

In general formula (XIII), L is an independently selected ligand having organo groups with a sufficient number of carbon atoms to render the compounds soluble or dispersible in the oil. In general formula (XIII), n is a number from 1 to 4. Also in general formula (XIII), k is a number from 4 to 7. Further in general formula (XIII), Q is selected from the group of neutral electron donating compounds such as water, amines, alcohols, phosphines, and ethers. Also in general formula (XIII), z is a number from 0 to 5. In certain embodiments, at least 21, at least 25, at least 30, or at least 35, total carbon atoms should be present among all the ligands' organo groups of the anti-wear agent including molybdenum.

In various embodiments, the anti-wear agent of the additive package or the lubricant composition may include phosphorus and molybdenum in a single compound. It is to be appreciated that one or more of the anti-wear agents including phosphorus described above may include phosphorus and molybdenum in a single compound. It is also to be appreciated that one or more of the anti-wear agents including molybdenum described above may include phosphorus and molybdenum in a single compound.

In other embodiments, the additive package or the lubricant composition may include the anti-wear agent including phosphorus, such as any of the anti-wear agents including phosphorus described above, and the anti-wear agent including molybdenum, such as any of the anti-wear agents including molybdenum described above. For example, the additive package or the lubricant composition may include a ZDDP and molybdenum dithiocarbamate. The additive package or the lubricant composition may also include any other type of anti-wear agent understood in the art.

The anti-wear agent may be present in the additive package in an amount of from 0.01 to 80, 0.05 to 50, 0.1 to 25, 0.1 to 15, 0.1 to 10, 0.1 to 5, 0.1 to 2, or 0.1 to 1, wt. %, each based on the total weight of the additive package. Alternatively, the anti-wear agent may be present in amounts of less than 80, less than 50, less than 25, less than 15, less than 10, less than 5, less than 2, or less than 1, wt. %, each based on the total weight of the additive package.

The anti-wear agent may be present in the lubricant composition in an amount of from 0.001 to 30, 0.005 to 20, 0.005 to 10, 0.01 to 5, 0.01 to 2, 0.01 to 1, 0.01 to 0.5, or 0.01 to 0.2, wt. %, based on the total weight of the lubricant composition. Alternatively, the anti-wear agent may be present in amounts of less than 30, less than 20, less than 10, less than 5, less than 2, less than 1, less than 0.5, or less than 0.2, wt. %, based on the total weight of the lubricant composition.

The additive package or the lubricant composition may include the anti-wear agent including phosphorus and the anti-wear agent including molybdenum in a weight ratio of from 99:1 to 1:99, 90:10 to 10:90, 80:20 to 20:80, 70:30 to 30:70, 60:40 to 40:60, or 55:45 to 45:55, of the anti-wear agent including phosphorus to the anti-wear agent including molybdenum.

In other embodiments, the additive package may consist, or consist essentially of the alkoxylated amide, the ester, and the anti-wear agent. It is also contemplated that the additive package may consist of, or consist essentially of, the alkoxylated amide, the ester, and the anti-wear agent in addition to at least one of the additives that do not materially affect the functionality or performance of the alkoxylated amide, the ester, or the anti-wear agent. When used in reference to the additive package, the term "consisting essentially of" refers to the additive package being free of compounds that materially affect the overall performance of the additive package. For example, compounds that materially affect the overall performance of the additive package may include compounds which impact the TBN boost, the lubricity, the corrosion inhibition, the acidity, the detergency, or the metal surface cleanliness of the additive package.

In various embodiments, the additive package is substantially free of water, e.g., the additive package includes less than 5, 4, 3, 2, 1, 0.5, or 0.1, wt. %, of water based on the total weight of the additive package. Alternatively, the additive package may be completely free of water.

As introduced above, the additive package may be formulated to provide the desired concentration in the lubricant composition. In these embodiments, the lubricant composition includes the alkoxylated amide, the ester, the anti-wear agent, and a base oil. It is to be appreciated that most references to the lubricant composition throughout this disclosure also apply to the description of the additive package. For example, it is to be appreciated that the additive package may include, or exclude, the same components as the lubricant composition, albeit in different amounts.

The base oil is classified in accordance with the American Petroleum Institute (API) Base Oil Interchangeability Guidelines. In other words, the base oil may be further described as at least one of five types of base oils: Group I (sulphur content >0.03 wt. %, and/or <90 wt. % saturates, viscosity index 80-119); Group II (sulphur content less than or equal to 0.03 wt. %, and greater than or equal to 90 wt. % saturates, viscosity index 80-119); Group III (sulphur content less than or equal to 0.03 wt. %, and greater than or equal to 90 wt. % saturates, viscosity index greater than or equal to 119); Group IV (all polyalphaolefins (PAO's)); and Group V (all others not included in Groups I, II, III, or IV).

In some embodiments, the base oil is selected from the group of API Group I base oils; API Group II base oils; API Group III base oils; API Group IV base oils; API Group V base oils; and combinations thereof. In other embodiments, the lubricant composition is free from Group I, Group II, Group III, Group IV, or Group V, base oils, and combinations thereof. In one embodiment, the base oil includes API Group II base oils.

The base oil may have a viscosity of from 1 to 50, 1 to 40, 1 to 30, 1 to 25, or 1 to 22, cSt, when tested according to ASTM D445 at 100° C. Alternatively, the viscosity of the base oil may range from 3 to 22, 3 to 17, or 5 to 14, cSt, when tested according to ASTM D445 at 100° C.

The base oil may be further defined as a crankcase lubricant composition for spark-ignited and compression-ignited internal combustion engines, including automobile and truck engines, two-cycle engines, aviation piston engines, marine engines, and railroad diesel engines. Alternatively, the base oil can be further defined as an oil to be used in gas engines, diesel engines, stationary power engines, and turbines. The base oil may be further defined as heavy or light duty engine oil.

In still other embodiments, the base oil may be further defined as synthetic oil that includes at least one alkylene oxide polymers and interpolymers, and derivatives thereof. The terminal hydroxyl groups of the alkylene oxide polymers may be modified by esterification, etherification, or similar reactions. These synthetic oils may be prepared through polymerization of ethylene oxide or propylene oxide to form polyoxyalkylene polymers which can be further reacted to form the synthetic oil. For example, alkyl and aryl ethers of these polyoxyalkylene polymers may be used. For example, methylpolyisopropylene glycol ether having a weight average molecular weight of 1000; diphenyl ether of polyethylene glycol having a molecular weight of 500-1000; or diethyl ether of polypropylene glycol having a weight average molecular weight of 1000-1500 and/or mono- and polycarboxylic esters thereof, such as acetic acid esters, mixed $C_3$-$C_8$ fatty acid esters, and the $C_{13}$ oxo acid diester of tetraethylene glycol may also be utilized as the base oil. Alternatively, the base oil may include a substantially inert, normally liquid, organic diluent, such as mineral oil, naptha, benzene, toluene, or xylene.

The base oil may include less than 90, less than 80, less than 70, less than 60, less than 50, less than 40, less than 30, less than 20, less than 10, less than 5, less than 3, less than 1, wt. %, or be free from, an estolide compound (i.e., a compound including at least one estolide group), based on the total weight of the lubricant composition.

The base oil may be present in the lubricant composition in an amount of from 1 to 99.9, 50 to 99.9, 60 to 99.9, 70 to 99.9, 80 to 99.9, 90 to 99.9, 75 to 95, 80 to 90, or 85 to 95, wt. %, based on the total weight of the lubricant composition. Alternatively, the base oil may be present in the lubricant composition in amounts of greater than 1, 10, 20, 30, 40, 50, 60, 70, 75, 80, 85, 90, 95, 98, or 99, wt. %, based on the total weight of the lubricant composition. In various embodiments, the amount of base oil in a fully formulated lubricant composition (including diluents or carrier oils present) ranges from 50 to 99, 60 to 90, 80 to 99.5, 85 to 96, or 90 to 95, wt. %, based on the total weight of the lubricant composition. Alternatively, the base oil may be present in the lubricant composition in an amount of from 0.1 to 50, 1 to 25, or 1 to 15, wt. %, based on the total weight of the lubricant composition. In various embodiments, the amount of base oil in an additive package, if included, (including diluents or carrier oils present) ranges from 0.1 to 50, 1 to 25, or 1 to 15, wt. %, based on the total weight of the additive package.

The lubricant composition can be employed in a variety of lubricants based on diverse oils of lubricating viscosity, including natural and synthetic lubricating oils and mixtures thereof. These lubricants include crankcase lubricating oil for spark-ignited and compression-ignited internal combustion engines, including automobile and truck engines; two cylinder engines; aviation piston engines; marine and railroad diesel engines, and the like.

The lubricant composition may include less than 50, less than 25, less than 10, less than 5, less than 1, less than 0.1, or less than 0.01, wt. %, of a fluorinated base oil, or the lubricant composition may be free from a fluorinated base oil. The phrase "fluorinated base oil" may be understood to include any fluorinated oil components, such as perfluoropolyethers or fluorocarbons.

In some aspects, the fluorinated base oil may also be generally defined as any component that includes more than 1, 5, 10, 15, or 20 fluorine atoms per molecule.

In some embodiments, the lubricant composition is a 'wet' lubricant composition that includes at least one liquid component. The lubricant composition is not a dry lubricant as it requires at least one liquid component to properly lubricate.

In one or more embodiments, the lubricant composition may be classified as a low SAPS lubricant having a sulfated ash content of no more than 3, 2, 1, or 0.5, wt. %, based on the total weight of the lubricant composition. "SAPS" refers to sulfated ash, phosphorous and sulfur.

One method of evaluating the anti-wear properties of a lubricant composition is to determine the friction coefficient of the lubricant composition. In certain embodiments, the friction coefficient of the lubricant composition is determined according to a modified ASTM D 6079 method. The modified ASTM D 6079 method utilizes a High Frequency Reciprocating Rig (HFRR) for determining the friction coefficient. During the determination, the HFRR reciprocates at 10 Hz and has a 1 mm stroke. The determination is conducted at a temperature of 100° C. for duration of 120 minutes with a 400 gram load. The lubricant composition may have a friction coefficient of less than or equal to 0.19, less than or equal to 0.18, less than or equal to 0.17, less than or equal to 0.16, less than or equal to 0.15, according to the modified ASTM D 6079 method.

Another method of evaluating the anti-wear properties of a lubricant composition is to determine the ball scar diameter of the lubricant composition. In certain embodiments, the ball scar diameter of the lubricant composition is determined by a laser profilometer. During the determination, standard HFRSSP steel balls are utilized with the laser profilometer. The lubricant composition may have a ball scar diameter of less than or equal to 260, less than or equal to 250, less than or equal to 240, less than or equal to 230, less than or equal to 220, μm.

The fuel economy increase for vehicles utilizing a lubricant composition may be determined according to the EPA Highway Fuel Economy Driving Schedule (HWFET). HWFET is a chassis dynamometer driving schedule developed by the U.S. EPA for the determination of fuel economy of light duty vehicles. In accordance with HWFET, each vehicle utilizing the lubricant composition is tested for 765 seconds to a distance of 10.26 miles at an average speed of 48.3 miles per hour. The lubricant composition including the alkoxylated amide, the ester, and the anti-wear agent may improve fuel economy by at least 0.75, at least 1, at least 1.25, at least 1.3, or at least 1.35, %, according to HWFET.

The fuel consumption of an engine may be determined by operating the engine at controlled steady state conditions simulating highway temperatures, speed, and load over a designated time period, such as a 70 hour period. During the designated time period, the fuel consumption may be measured with a Coriolis-type fuel flow meter. The engine utilized for the fuel consumption determination may be a 5.7 liter GM crate engine. The fuel consumption of an engine utilizing the lubricant composition including the alkoxylated amide, the ester, and the anti-wear agent may reduce fuel consumption by at least 1, at least 2, at least 3, at least 4, at least 5, or at least 6, %.

The lubricant composition may have a TBN value of at least 1, at least 3, at least 5, at least 7, at least 9, mg KOH/g of lubricant composition, when tested according to ASTM D2896. Alternatively, the lubricant composition has a TBN value of from 3 to 100, 3 to 75, 50 to 90, 3 to 45, 3 to 35, 3 to 25, 3 to 15, or 9 to 12, mg KOH/g of lubricant composition, when tested according to ASTM D2896.

In certain embodiments, the lubricant composition is a multigrade lubricant composition identified by the viscometric descriptor SAE15WX, SAE 10WX, SAE 5WX or SAE 0WX, where X is 8, 12, 16, 20, 30, 40, or 50. The characteristics of at least one of the different viscometric grades can be found in the SAE J300 classification.

In other embodiments, the lubricant composition has a lower viscosity grade than SAE 30, such as SAE 20, SAE 16, SAE 15 SAE 12, SAE 10, SAE 10W, SAE 8, SAE 5, SAE 5W, SAE 4, SAE 0W, and combinations thereof, as defined by the Society of Automotive Engineers (SAE) J300.

The lubricant composition may have a phosphorus content of less than 1500, less than 1200, less than 1000, less than 800, less than 600, less than 400, less than 300, less than 200, or less than 100, or 0, ppm, as measured according to the ASTM D5185 standard, or as measured according to the ASTM D4951 standard. The lubricant composition may have a sulfur content of less than 3000, less than 2500, less than 2000, less than 1500, less than 1200, less than 1000, less than 700, less than 500, less than 300, or less than 100, ppm, as measured according to the ASTM D5185 standard, or as measured according to the ASTM D4951 standard.

Alternatively, the lubricant composition may have a phosphorous content of from 1 to 1000, 1 to 800, 100 to 700, or 100 to 600, ppm, as measured according to the ASTM D5185 standard.

The lubricant composition may be unreactive with water. By unreactive with water, it is meant that less than 5, 4, 3, 2, 1, 0.5, or 0.1, wt., %, of the lubricant composition reacts with water at 1 atmosphere of pressure and 25° C.

The lubricant composition may include less than 50, less than 25, less than 10, less than 5, less than 1, less than 0.1, or less than 0.01, wt. %, of a halogen-containing compound, such as a compound that includes fluorine, chlorine, iodine, or bromine, such as alkyl halides or halogen ether compounds, based on the total weight of the lubricant composition.

In one embodiment, the lubricant composition passes ASTM D5185, API GF-5, and/or API CJ-4 for phosphorus content. ASTM D5185 is a standard test method for determination of additive elements in lubricant compositions by inductively coupled plasma atomic emission spectrometry (ICP-AES).

In another embodiment, the lubricant composition passes ACEA 2012 for engine oils. ACEA 2012 is a certification for sequences that define the minimum quality level of a engine oil.

In another embodiment, the lubricant composition passes ASTM D6795, which is a standard test method for measuring the effect on filterability of lubricant compositions after treatment with water and dry ice and a short (30 min) heating time. ASTM D6795 simulates a problem that may be encountered in a new engine run for a short period of time, followed by a long period of storage with some water in the oil. ASTM D6795 is designed to determine the tendency of a lubricant composition to form a precipitate that can plug an oil filter.

In another embodiment, the lubricant composition passes ASTM D6794, which is a standard test method for measuring the effect on filterability of lubricant composition after treatment with various amounts of water and a long (6 h) heating time. ASTM D6794 simulates a problem that may be encountered in a new engine run for a short period of time, followed by a long period of storage with some water in the oil. ASTM D6794 is also designed to determine the tendency of the lubricant composition to form a precipitate that can plug an oil filter.

In another embodiment, the lubricant composition passes ASTM D6922, which is a standard test method for determining homogeneity and miscibility in lubricant compositions. ASTM D6922 is designed to determine if a lubricant composition is homogeneous and will remain so, and if the lubricant composition is miscible with certain standard reference oils after being submitted to a prescribed cycle of temperature changes.

In another embodiment, the lubricant composition passes ASTM D5133, which is a standard test method for low temperature, low shear rate, viscosity/temperature dependence of lubricating oils using a temperature-scanning technique. The low-temperature, low-shear viscometric behavior of a lubricant composition determines whether the lubricant composition will flow to a sump inlet screen, then to an oil pump, then to sites in an engine requiring lubrication in sufficient quantity to prevent engine damage immediately or ultimately after cold temperature starting.

In another embodiment, the lubricant composition passes ASTM D5800 and/or ASTM D6417, both of which are test methods for determining an evaporation loss of a lubricant composition. The evaporation loss is of particular importance in engine lubrication, because where high temperatures occur, portions of a lubricant composition can evaporate and thus alter the properties of the lubricant composition.

In another embodiment, the lubricant composition passes ASTM D6557, which is a standard test method for evaluation of rust preventive characteristics of lubricant compositions. ASTM D6577 includes a Ball Rust Test (BRT) procedure for evaluating the anti-rust ability of lubricant compositions. This BRT procedure is particularly suitable for the evaluation of lubricant compositions under low-temperature and acidic service conditions.

In another embodiment, the lubricant composition passes ASTM D4951 for sulfur content. ASTM D4951 is a standard test method for determination of additive elements in lubricant compositions by ICP-OES. In addition, the lubricant composition also passes ASTM D2622, which is a standard test method for sulfur in petroleum products by wavelength dispersive x-ray fluorescence spectrometry.

In another embodiment, the lubricant composition passes ASTM D6891, which is a standard test method for evaluating a lubricant composition in a sequence IVA spark-ignition engine. ASTM D6891 is designed to simulate extended engine idling vehicle operation. Specifically, ASTM D6891 measures the ability of a lubricant composition to control camshaft lobe wear for spark-ignition engines equipped with an overhead valve-train and sliding cam followers.

In another embodiment, the lubricant composition passes ASTM D6593, which is a standard test method for evaluating lubricant compositions for inhibition of deposit formation in a spark-ignition internal combustion engine fueled with gasoline and operated under low-temperature, light-duty conditions. ASTM D6593 is designed to evaluate a lubricant composition's control of engine deposits under operating conditions deliberately selected to accelerate deposit formation.

In another embodiment, the lubricant composition passes ASTM D6709, which is a standard test method for evaluating lubricant compositions in a sequence VIII spark-ignition engine. ASTM D6709 is designed to evaluate lubricant compositions for protection of engines against bearing weight loss.

In yet another embodiment, the lubricant composition passes ASTM D6984, which is a standard test method for evaluation of automotive engine oils in the Sequence IIIF, Spark-Ignition. In other words, the viscosity increase of the lubricant composition at the end of the test is less than 275% relative to the viscosity of the lubricant composition at the beginning of the test.

In another embodiment, the lubricant composition passes two, three, four, or more of the following standard test methods: ASTM D4951, ASTM D6795, ASTM D6794, ASTM D6922, ASTM D5133, ASTM D6557, ASTM D6891, ASTM D2622, ASTM D6593, and ASTM D6709.

The lubricant composition, such as a crankcase lubricant composition, may include the additive package in amount of (or have a total additive treat rate of) at least 0.1, at least 1, at least 2, at least 3, at least 4, at least 5, at least 6, at least 7, or at least 8, wt. %, based on a total weight of the lubricant composition. Alternatively, the lubricant composition may include the additive package in amount of (or have a total additive treat rate of) from 3 to 20, 4 to 18, 5 to 16, or 6 to 14, wt. %, based on a total weight of the lubricant composition. Alternatively, the lubricant composition may include the additive package in amount of (or have a total additive treat rate of) from 0.1 to 10, 0.1 to 5, 0.1 to 1, wt. %, based on a total weight of the lubricant composition. The additive package may be blended into the base oil to make the lubricant composition. The term "total additive treat rate" refers to the total weight percentage of additives included in the lubricant composition.

In certain embodiments, an additive is any compound in the lubricant composition other than the base oil. In other words, the total additive treat rate calculation does not account for the base oil as an additive. However, it is to be appreciated that certain individual components can be independently and individually added to the lubricant composition separate from the addition of the additive package to the lubricant composition, yet still be considered part of the additive package once the additive which was individually added into the lubricant composition is present in the lubricant composition along with the other additives. As just one example, a base oil which includes the alkoxylated amide, the ester, the anti-wear agent, and the dispersant, each added to the base oil separately, could be interpreted to be a lubricant composition that includes an additive package including the alkoxylated amide, the ester, the anti-wear agent, and the dispersant.

In certain embodiments, the lubricant composition may consist, or consist essentially of, the alkoxylated amide, the ester, the anti-wear agent, and the base oil. It is also contemplated that the lubricant composition may consist of, or consist essentially of, the alkoxylated amide, the ester, the anti-wear agent, and the base oil, in addition to at least one of the additives that do not materially affect the functionality or performance of the alkoxylated amide, the ester, the anti-wear agent, or the base oil. When used in reference to the lubricant composition, the term "consisting essentially of" refers to the lubricant composition being free of compounds that materially affect the overall performance of the lubricant composition. For example, compounds that materially affect the overall performance of the lubricant composition may include compounds which impact the TBN boost, the lubricity, the corrosion inhibition, the acidity, the detergency, or the metal surface cleanliness of the lubricant composition.

In various embodiments, the lubricant composition is substantially free of water, e.g., the lubricant composition includes less than 5, less than 4, less than 3, less than 2, less than 1, less than 0.5, or less than 0.1, wt. %, of water, based on the total weight of the lubricant composition. Alternatively, the lubricant composition may be completely free of water.

The additive package or lubricant composition may additionally include at least one additive to improve various chemical and/or physical properties of the resultant lubricant composition. Specific examples of the additives include, but are not limited to, anti-wear additives in addition to the anti-wear agent, antioxidants, metal deactivators (or passivators), rust inhibitors, friction modifiers (or antifriction additives), viscosity index improvers (or viscosity modifiers), pour point depressants (or pour point depressors), dispersants, detergents, anti-foam additives, amine compounds, and combinations thereof. Each of the additives may be used alone or in combination. The additive(s) can be used in various amounts, if employed.

If employed, the anti-wear additive can be of various types. Suitable examples of anti-wear agents include, but are not limited to, sulfur- and/or phosphorus- and/or halogen-containing compounds, e.g., sulfurised olefins and vegetable oils, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio]propionate, triphenyl thiophosphate (triphenylphosphorothioate), tris(alkylphenyl) phosphorothioate and mixtures thereof, diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris[isooctyl 2-acetate], derivatives of 2-mercaptobenzothiazole such as 1-[N,N-bis(2-ethylhexyl) aminomethyl]-2-mercapto-1H-1,3-benzothiazole, ethoxycarbonyl-5-octyldithio carbamate, and/or combinations thereof.

If employed, the antioxidant can be of various types which include, but are not limited to, aminic antioxidants and phenolic antioxidants. Suitable examples of antioxidants include, but are not limited to, alkylated monophenols, for example 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(a-methylcyclohexyl)-4,6-dimethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6(1'-methylundec-1'-yl)phenol, 2,4-dimethyl-6-(1'-methylheptadec-1'-yl)phenol, 2,4-dimethyl-6-(1'-methyltridec-1'-yl)phenol, and combinations thereof.

Further examples of suitable antioxidants includes alkylthiomethylphenols, for example, 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol, and combinations thereof. Hydroquinones and alkylated hydroquinones, for example, 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis-(3,5-di-tert-butyl-4-hydroxyphenyl) adipate, and combinations thereof, may also be utilized.

Furthermore, hydroxylated thiodiphenyl ethers, for example 2,2'-thiobis(6-tert-butyl-4-methylphenol), 2,2'-thiobis(4-octylphenol), 4,4'-thiobis(6-tert-butyl-3-methylphenol), 4,4'-thiobis(6-tert-butyl-2-methylphenol), 4,4'-thiobis-(3,6-di-sec-amylphenol), 4,4'-bis-(2,6-dimethyl-4-hydroxyphenyl)disulfide, and combinations thereof, may also be used.

It is also contemplated that alkylidenebisphenols, for example 2,2'-methylenebis(6-tert-butyl-4-methylphenol), 2,2'-methylenebis(6-tert-butyl-4-ethylphenol), 2,2'-methylenebis[4-methyl-6-(a-methylcyclohexyl)phenol], 2,2'-methylenebis(4-methyl-6-cyclohexylphenol), 2,2'-methylenebis (6-nonyl-4-methylphenol), 2,2'-methylenebis(4,6-di-tert-butylphenol), 2,2'-ethylidenebis (4,6-di-tert-butylphenol), 2,2'-ethylidenebis(6-tert-butyl-4-isobutylphenol), 2,2'-methylenebis [6-(a-methylbenzyl)-4-nonylphenol], 2,2'-methylenebis[6-(a,a-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methyl-phenyl)-3-n-dodecylmercaptobutane, ethylene glycol bis[3,3-bis(3'-tert-butyl-4'-hydroxyphenyl) butyrate], bis(3-tert-butyl-4-hydroxy-5-methyl-phenyl)dicyclopentadiene, bis[2-(3'-tert-butyl-2'-hydroxy-5'-methylbenzyl)-6-tert-butyl-4-methylphenyl]terephthalate, 1,1-bis-(3,5-dimethyl-2-hydroxyphenyl)butane, 2,2-bis-(3,5-di-tert-butyl-4-hydroxyphenyl)propane, 2,2-bis-(5-tert-butyl-4-hydroxy-2-methylphenyl)-4-n-dodecylmercaptobutane, 1,1,5,5-tetra-(5-tert-butyl-4-hydroxy-2-methyl phenyl)pentane, and combinations thereof may be utilized as antioxidants in the lubricant composition.

O-, N- and S-benzyl compounds, for example 3,5,3',5'-tetra-tert-butyl-4,4'-dihydroxydibenzyl ether, octadecyl-4-hydroxy-3,5-dimethylbenzylmercaptoacetate, tris-(3,5-di-tert-butyl-4-hydroxybenzyl)amine, bis(4-tert-butyl-3-hydroxy-2,6-dimethylbenzyl)dithiol terephthalate, bis(3,5-di-tert-butyl-4-hydroxybenzyl)sulfide, isooctyl-3,5di-tert-butyl-4-hydroxy benzylmercaptoacetate, and combinations thereof, may also be utilized.

Hydroxybenzylated malonates, for example dioctadecyl-2,2-bis-(3,5-di-tert-butyl-2-hydroxybenzyl)-malonate, di-octadecyl-2-(3-tert-butyl-4-hydroxy-5-methylbenzyl)-malonate, di-dodecylmercaptoethyl-2,2-bis-(3,5-di-tert-butyl-4-hydroxybenzyl)malonate, bis [4-(1,1,3,3-tetramethyl-butyl)phenyl]-2,2-bis(3,5-di-tert-butyl-4-hydroxybenzyl) malonate, and combinations thereof are also suitable for use as antioxidants.

Triazine compounds, for example, 2,4-bis(octylmercapto)-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl)isocyanurate, 1,3,5-tris(4-tert-butyl-3-hydroxy-2,6-dimethylbenzyl 2,4,6-tris (3,5-di-tert-butyl-4-hydroxyphenylethyl)-1,3,5-triazine, 1,3,5-tris (3,5-di-tert-butyl-4-hydroxyphenyl propionyl)-hexahydro-1,3,5-triazine, 1,3,5-tris-(3,5-dicyclohexyl-4-hydroxybenzyl)-isocyanurate, and combinations thereof, may also be used.

Additional examples of antioxidants include aromatic hydroxybenzyl compounds, for example 1,3,5-tris-(3,5-di-tert-butyl-4-hydroxybenzyl)-2,4,6-trimethylbenzene, 1,4-bis(3,5-di-tert-butyl-4-hydroxybenzyl)-2,3,5,6-tetramethyl-benzene, 2,4,6-tris(3,5-di-tert-butyl-4-hydroxybenzyl) phenol, and combinations thereof. Benzylphosphonates, for example dimethyl-2,5-di-tert-butyl-4-hydroxybenzylphosphonate, diethyl-3,5-di-tert-butyl-4-hydroxybenzylphosphonate, dioctadecyl3,5-di-tert-butyl-4-hydroxybenzyl-phosphonate, dioctadecyl-5-tert-butyl-4-hydroxy3-methylbenzylphosphonate, the calcium salt of the monoethyl ester of 3,5-di-tert-butyl-4-hydroxybenzylphosphonic acid, and combinations thereof, may also be utilized. In addition, acylaminophenols, for example 4-hydroxylauranilide, 4-hydroxystearanilide, octyl N-(3,5-di-tert-butyl-4-hydroxyphenyl)carbamate.

Esters of [3-(3,5-di-tert-butyl-4-hydroxyphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis (hydroxyethyl)oxamide, 3-thiaundecanol, 3-thiapentadecanol, trimethylhexanediol, trimethylolpropane, 4-hydroxymethyl-1-phospha-2,6,7-trioxabicyclo [2.2.2]octane, and combinations thereof, may also be used. It is further contemplated that esters of b-(5-tert-butyl-4-hydroxy-3-methylphenyl)-propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris (hydroxyethyl)isocyanurate, N,N'-bis(hydroxyethyl) oxamide, 3-thiaundecanol, 3-thiapentadecanol, trimethylhexanediol, trimethylolpropane, 4-hydroxymethyl-1-phospha-2,6,7-trioxabicyclo octane, and combinations thereof, may be used.

Additional examples of suitable antioxidants include those that include nitrogen, such as amides of b-(3,5-di-tert-butyl-4-hydroxyphenyl)propionic acid, e.g., N,N'-bis(3,5-di-tert-butyl-4-hydroxyphenylpropionyl)hexamethylenediamine, N,N'-bis(3,5-di-tert-butyl-4-hydroxyphenylpropionyl)trimethylenediamine, N,N'-bis(3,5-di-tert-butyl-4-hydroxyphenylpropionyl)hydrazine. Other suitable examples of antioxidants include aminic antioxidants such as N,N'-diisopropyl-p-phenylenediamine, N,N'-di-sec-butyl-p-phenylenediamine, N,N'-bis (1,4-dimethyl-pentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N'-bis(2-naphthyl)-p-phenylenediamine, N-isopropyl-N'-phenyl-p-phenylenediamine, N-(1,3-dimethyl-butyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfamoyl)diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, bis(4-methoxyphenyl)amine, 2,6-di-tert-butyl-4-dimethylamino methylphenol, 2,4'-diaminodiphenylmethane, 4,4'-diaminodiphenylmethane, N,N,N',N'-tetramethyl-4,4'-diaminodiphenylmethane, 1,2-bis[(2-methyl-phenyl)amino]ethane, 1,2-bis(phenylamino)propane, (o-tolyl)biguanide, bis[4-(1',3'-dimethylbutyl)phenyl]amine, tert-octylated N-phenyl-1-naphthylamine, a mixture of mono- and dialkylated tert-butyl/tert-octyldiphenylamines, a mixture of mono- and dialkylated isopropyl/isohexyldiphenylamines, mixtures of mono- and dialkylated tert-butyldiphenylamines, 2,3-dihydro-3,3-dimethyl-4H-1,4-benzothiazine, phenothiazine, N-allylphenothiazine, N,N,N',N'-tetraphenyl-1,4-diaminobut-2-ene, N,N-bis(2,2,6,6-tetramethylpiperid-4-yl-hexamethylenediamine, bis(2,2,6,6-tetramethyl piperid-4-yl)sebacate, 2,2,6,6-tetramethylpiperidin-4-one and 2,2,6,6-tetramethyl piperidin-4-ol, and combinations thereof.

Even further examples of suitable antioxidants include aliphatic or aromatic phosphites, esters of thiodipropionic acid or of thiodiacetic acid, or salts of dithiocarbamic or dithiophosphoric acid, 2,2,12,12-tetramethyl-5,9-dihydroxy-3,7,1trithiatridecane and 2,2,15,15-tetramethyl-5,12-dihydroxy-3,7,10,14-tetrathiahexadecane, and combinations thereof. Furthermore, sulfurized fatty esters, sulfurized fats and sulfurized olefins, and combinations thereof, may be used.

If employed, the antioxidant can be used in various amounts. The antioxidant may be present in the additive package in an amount ranging from 0.1 to 99, from 1 to 70, from 5 to 50, or from 25 to 50, wt. %, based on the total weight of the additive package. The antioxidant may be present in the lubricant composition in an amount ranging from 0.01 to 5, from 0.1 to 3, or from 0.5 to 2, wt. %, based on the total weight of the lubricant composition.

If employed, the metal deactivator can be of various types. Suitable examples of metal deactivators include, but are not limited to, benzotriazoles and derivatives thereof, for example 4- or 5 alkylbenzotriazoles (e.g. tolutriazole) and derivatives thereof, 4,5,6,7-tetrahydrobenzotriazole and 5,5'-methylenebisbenzotriazole; Mannich bases of benzotriazole or tolutriazole, e.g. 1-[bis(2-ethylhexyl)aminomethyl) tolutriazole and 1-[bis(2-ethylhexyl)aminomethyl)benzotriazole; and alkoxyalkylbenzotriazoles such as 1-(nonyloxymethyl)benzotriazole, 1-(1-butoxyethyl)benzotriazole and 1-(1-cyclohexyloxybutyl) tolutriazole, and combinations thereof.

Additional examples of suitable metal deactivators include 1,2,4-triazoles and derivatives thereof, for example 3 alkyl(or aryl)-1,2,4-triazoles, and Mannich bases of 1,2,4-triazoles, such as 1-[bis(2-ethylhexyl)aminomethyl-1,2,4-triazole; alkoxyalkyl-1,2,4-triazoles such as 1-(1-butoxyethyl)-1,2,4-triazole; and acylated 3-amino-1,2,4-triazoles, imidazole derivatives, for example 4,4'-methylenebis(2-undecyl-5-methylimidazole) and bis[(N-methyl)imidazol-2-yl] carbinol octyl ether, and combinations thereof. Further examples of suitable metal deactivators include sulfur-containing heterocyclic compounds, for example 2-mercaptobenzothiazole, 2,5-dimercapto-1,3,4-thiadiazole and derivatives thereof; and 3,5-bis[di(2-ethylhexyl)aminomethyl]-1,3,4-thiadiazolin-2-one, and combinations thereof. Even further examples of metal deactivators include amino compounds, for example salicylidenepropylenediamine, salicylaminoguanidine and salts thereof, and combinations thereof.

If employed, the metal deactivator can be used in various amounts. The metal deactivator may be present in the additive package in an amount ranging from 0.1 to 99, from 1 to 70, from 5 to 50, or from 25 to 50, wt. %, based on the total weight of the additive package.

The metal deactivator may be present in the lubricant composition in an amount ranging from 0.01 to 0.1, from 0.05 to 0.01, or from 0.07 to 0.1, wt. %, based on the total weight of the lubricant composition.

If employed, the rust inhibitor and/or friction modifier can be of various types. Suitable examples of rust inhibitors and/or friction modifiers include, but are not limited to, organic acids, their esters, metal salts, amine salts and anhydrides, for example alkyl- and alkenylsuccinic acids and their partial esters with alcohols, diols or hydroxycarboxylic acids, partial amides of alkyl- and alkenylsuccinic acids, 4-nonylphenoxyacetic acid, alkoxy- and alkoxyethoxycarboxylic acids such as dodecyloxyacetic acid, dodecyloxy(ethoxy)acetic acid and the amine salts thereof, and also N-oleoylsarcosine, sorbitan monooleate, lead naphthenate, alkenylsuccinic anhydrides, for example, dodecenylsuccinic anhydride, 2-carboxymethyl-1-dodecyl-3-methylglycerol and the amine salts thereof, and combinations thereof. Additional examples include nitrogen-containing compounds, for example, primary, secondary or tertiary aliphatic or cycloaliphatic amines and amine salts of organic and inorganic acids, for example oil-soluble alkylammonium carboxylates, and also 1-[N,N-bis(2-hydroxyethyl) amino]-3-(4-nonylphenoxy)propan-2-ol, and combinations thereof. Further examples include heterocyclic compounds, such as substituted imidazolines and oxazolines, and 2-heptadecenyl-1-(2-hydroxyethyl)imidazoline, phosphorus-containing compounds, for example: amine salts of phosphoric acid partial esters or phosphonic acid partial esters, molybdenum containing compounds, such as molydbenum dithiocarbamate and other sulphur and phosphorus containing derivatives, sulfur-containing compounds, for example: barium dinonylnaphthalenesulfonates, calcium petroleum sulfonates, alkylthio-substituted aliphatic carboxylic acids, esters of aliphatic 2-sulfocarboxylic acids and salts thereof, glycerol derivatives, for example: glycerol monooleate, 1-(alkylphenoxy)-3-(2-hydroxyethyl)glycerols, 1-(alkylphenoxy)-3-(2,3-dihydroxypropyl)glycerols and 2-carboxyalkyl-1,3-dialkylglycerols, and combinations thereof.

If employed, the rust inhibitor and/or friction modifier can be used in various amounts. The rust inhibitor and/or friction modifier may be present in the additive package in an amount ranging from 0.01 to 0.1, from 0.05 to 0.01, or from 0.07 to 0.1, wt. %, based on the total weight of the additive package. The rust inhibitor and/or friction modifier may be present in the lubricant composition in an amount ranging from 0.01 to 5, from 0.1 to 3, from 0.1 to 1, from 0.05 to 0.01, or from 0.07 to 0.1, wt. %, based on the total weight of the lubricant composition.

If employed, the viscosity index improver (VII) can be of various types. Suitable examples of VIIs include, but are not limited to, polyacrylates, polymethacrylates, vinylpyrrolidone/methacrylate copolymers, polyvinylpyrrolidones, polybutenes, olefin copolymers, styrene/acrylate copolymers and polyethers, and combinations thereof.

If employed, the VII can be used in various amounts. The VII may be present in the additive package in an amount ranging from 0.01 to 20, from 1 to 15, or from 1 to 10, wt. %, based on the total weight of the additive package. The VII may be present in the lubricant composition in an amount ranging from 0.01 to 20, from 1 to 15, or from 1 to 10, wt. %, based on the total weight of the lubricant composition.

If employed, the pour point depressant can be of various types. Suitable examples of pour point depressants include, but are not limited to, polymethacrylate and alkylated naphthalene derivatives, and combinations thereof.

If employed, the pour point depressant can be used in various amounts. The pour point depressant may be present in the additive package in an amount ranging from 0.1 to 99, from 1 to 70, from 5 to 50, or from 25 to 50, wt. %, based on the total weight of the additive package. The pour point depressant may be present in the lubricant composition in an amount ranging from 0.01 to 0.1, from 0.05 to 0.01, or from 0.07 to 0.1, wt. %, based on the total weight of the lubricant composition.

If employed, dispersant can be of various types. Suitable examples of dispersants include, but are not limited to, amine dispersants, alkenyl radicals, polybutenylsuccinic amides or -imides, polybutenylphosphonic acid derivatives and basic magnesium, calcium and barium sulfonates and phenolates, succinate esters and alkylphenol amines (Mannich bases), and combinations thereof.

If employed, the amine dispersant may have a total base number of at least 15, at least 25, or at least 30, mg KOH/g of the amine dispersant when measured according to ASTM D4739. Alternatively, the TBN value of the amine dispersant may range from 15 to 100, from 15 to 80, or from 15 to 75, mg KOH/g of the amine dispersant, when measured according to ASTM D 4739.

In some embodiments, the amine dispersant includes a polyalkene amine including a polyalkene moiety. The polyalkene moiety is the polymerization product of identical or different, straight-chain or branched $C_{2-6}$ olefin monomers. Examples of suitable olefin monomers are ethylene, propylene, 1-butene, isobutene, 1-pentene, 2-methyl butene, 1-hexene, 2-methylpentene, 3-methylpentene, and 4-methylpentene. The polyalkene moiety has a weight average molecular weight of from 200 to 10000, from 500 to 10000, or from 800 to 5000.

The amine dispersant may include moieties derived from succinic anhydride and having hydroxyl and/or amino and/or amido and/or imido groups. For example, the amine dispersant may be derived from polyisobutenylsuccinic anhydride which is obtainable by reacting conventional or highly reactive polyisobutene having a weight average molecular weight of from 500 to 5000 with maleic anhydride by a thermal route or via the chlorinated polyisobutene. For examples, derivatives with aliphatic polyamines such as ethylenediamine, diethylenetriamine, triethylenetetramine or tetraethylenepentamine may be used.

To prepare the polyalkene amine, the polyalkene component may be aminated in a known manner. An exemplary process proceeds via the preparation of an oxo intermediate by hydroformylation and subsequent reductive amination in the presence of a suitable nitrogen compound.

If employed, suitable examples of alkenyl radicals include mono- or polyunsaturated, such as mono- or diunsaturated analogs of alkyl radicals has from 2 to 18 carbon atoms, in which the double bonds may be in any position in the hydrocarbon chain. Examples of $C_4$-$C_{18}$ cycloalkyl radical include cyclobutyl, cyclopentyl and cyclohexyl, and also the analogs thereof substituted by 1 to 3 $C_1$-$C_4$ alkyl radicals. The $C_1$-$C_4$ alkyl radicals are, for example, selected from methyl, ethyl, iso- or n-propyl, n-, iso-, sec- or tert-butyl. Examples of the arylalkyl radical include a $C_1$-$C_{18}$ alkyl group and an aryl group which are derived from a monocyclic or bicyclic fused or nonfused 4- to 7-membered, in particular 6 membered, aromatic or heteroaromatic group, such as phenyl, pyridyl, naphthyl and biphenyl. Other examples of the alkenyl radicals include poly(oxyalkyl) radicals and a polyalkylene polyamine radicals.

If employed, the dispersant can be used in various amounts. The dispersant may be present in the additive package in an amount ranging from 0.1 to 99.9, from 0.1 to 50, from 5 to 25, or from 5 to 20, wt. %, based on the total weight of the additive package. The dispersant may be present in the lubricant composition in an amount of from 0.01 to 15, 0.1 to 12, 0.5 to 10, or 1 to 8, wt. %, based on the total weight of the lubricant composition. Alternatively, the dispersant may be present in amounts of less than 15, less than 12, less than 10, less than 5, or less than 1, wt. %, each based on the total weight of the lubricant composition.

If employed, the detergent can be of various types. Suitable examples of detergents include, but are not limited to, overbased or neutral metal sulphonates, phenates and salicylates, and combinations thereof.

If employed, the detergent can be used in various amounts. The detergent may be present in the additive package in an amount ranging from 0.1 to 99, from 1 to 70, from 5 to 50, or from 25 to 50, wt. %, based on the total weight of the additive package. The detergent may be present in the lubricant composition in an amount ranging from 0.01 to 5, from 0.1 to 4, from 0.5 to 3, or from 1 to 3, wt. %, based on the total weight of the lubricant composition. Alternatively, the detergent may be present in amounts of less than 5, less than 4, less than 3, less than 2, or less than 1, wt. %, based on the total weight of the lubricant composition.

If employed, anti-foam additive can be of various types and used in various amounts. The anti-foam additive may be present in the additive package in an amount ranging from 0.01 to 1, from 0.01 to 0.5, from 0.01 to 0.1, or from 0.02 to 0.08, wt. %, based on the total weight of the additive package. The anti-foam additive may be present in the lubricant composition in an amount ranging from 0.001 to 1, 0.001 to 0.05, 0.001 to 0.01, or 0.002 to 0.008, wt. %, based on the total weight of the lubricant composition.

If employed, amine compound can be of various types. The amine compound includes at least one nitrogen atom. Furthermore, in some configurations, the amine compound does not include triazoles, triazines, or similar compounds where there are three or more nitrogen atoms in the body of a cyclic ring. The amine compound may be aliphatic.

In certain embodiments, the amine compound has a total base number (TBN) value of at least 10 mg KOH/g when tested according to ASTM D4739. Alternatively, the amine compound has a TBN value of at least 15, at least 20, at least 25, at least 80, at least 90, at least 100, at least 110, at least 120, at least 130, at least 140, at least 150, or at least 160, mg KOH/g, when tested according to ASTM D4739. Alternatively still, the amine compound may have a TBN value of from 80 to 600, from 90 to 500, from 100 to 300, or from 100 to 200, mg KOH/g, when tested according to ASTM D4739.

In some embodiments, the amine compound does not negatively affect the TBN of the lubricant compositions. Alternatively, the amine compound may improve the TBN of the lubricant composition by, at least 0.5, at least 1, at least 1.5, at least 2, at least 2.5, at least 3, at least 3.5, at least 4, at least 4.5, at least 5, at least 10, or at least 15, mg KOH/g of the amine compound. The TBN value of the lubricant composition can be determined according to ASTM D2896.

In some embodiments, the amine compound consists of, or consists essentially of, hydrogen, carbon, nitrogen, and oxygen. Alternatively, the amine compound may consist of, or consist essentially of, hydrogen, carbon, and nitrogen. In the context of the amine compound, the phrase "consist essentially of" refers to compounds where at least 95 mole % of the amine compound are the recited atoms (i.e., hydrogen, carbon, nitrogen, and oxygen; or hydrogen, carbon, and nitrogen). For example, if the amine compound consists essentially of hydrogen, carbon, nitrogen, and oxygen, at least 95 mole % of the amine compound is hydrogen, carbon, nitrogen, and oxygen. In certain configurations, at least 96, at least 97, at least 98, at least 99, or at least 99.9, mole %, of the amine compound are hydrogen, carbon, nitrogen and oxygen, or, in other embodiments, are carbon, nitrogen, and hydrogen.

The amine compound may consist of covalent bonds. The phrase "consist of covalent bonds" is intended to exclude those compounds which bond to the amine compound through an ionic association with at least one ionic atom or compound. That is, in configurations where the amine compound consists of covalent bonds, the amine compound excludes salts of amine compounds, for example, phosphate amine salts and ammonium salts. As such, in certain embodiments, the lubricant composition is free of a salt of the amine compound. For example, the lubricant compositions may be free of a phosphate amine salt, ammonium salt, and/or amine sulfate salt.

The amine compound may be a monomeric acyclic amine compound having a weight average molecular weight of less than 500. Alternatively, the monomeric acyclic amine compound may have a weight average molecular weight of less than 450, less than 400, less than 350, less than 300, less than 250, less than 200, or less than 150. Alternatively still, the amine compound may have a weight average molecular weight of at least 30, at least 50, at least 75, at least 100, at least 150, at least 200, or at least 250.

The term "acyclic" is intended to refer to amine compounds which are free from any cyclic structures and to exclude aromatic structures. For example, the monomeric acyclic amine compound does not include compounds having a ring having at least three atoms bonded together in a cyclic structure and those compounds including benzyl, phenyl, or triazole groups.

The monomeric acyclic amine includes monoamines and polyamines (including two or more amine groups). Exemplary monomeric acyclic amine compounds include, but are not limited to, primary, secondary, and tertiary amines.

The monomeric acyclic amine compound may alternatively include at least one other primary amines such as ethylamine, n-propylamine, isopropylamine, n-butylamine, isobutylamine, sec-butylamine, tert-butylamine, pentylamine, and hexylamine; primary amines of the formulas: $CH_3—O—C_2H_4—NH_2$, $C_2H_5—O—C_2H_4—NH_2$, $CH_3—O—C_3H_6—NH_2$, $C_2H_5—O—C_3H_6—NH_2$, $C_4H_9—O—C_4H_8—NH_2$, $HO—C_2H_4—NH_2$, $HO—C_3H_6—NH_2$ and $HO—C_4F_8—NH_2$; secondary amines, for example diethylamine, methylethylamine, di-n-propylamine, diisopropylamine, diisobutylamine, di-sec-butylamine, di-tert-butylamine, dipentylamine, dihexylamine; and also secondary amines of the formulas: $(CH_3—O—C_2H_4)_2NH$, $(C_2H_5—O—C_2H_4)_2NH$, $(CH_3—O—C_3H_6)_2NH$, $(C_2H_5—O—C_3H_6)_2NH$, $(n\text{-}C_4H_9—O—C_4F_8)_2NH$, $(HO—C_2H_4)_2NH$, $(HO—C_3H_6)_2NH$ and $(HO—C_4H_8)_2NH$; and polyamines, such as n-propylenediamine, 1,4-butanediamine, 1,6-hexanediamine, diethylenetriamine, triethylenetetramine and tetraethylenepentamines, and also their alkylation products, for example 3-(dimethylamino)-n-propylamine, N,N-dimethylethylenediamine, N,N-diethylethylenediamine, and N,N,N',N'-tetramethyldiethylenetriamine.

Alternatively, the amine compound may be a monomeric cyclic amine compound. The monomeric cyclic amine compound may have a weight average molecular weight of from 100 to 1200, from 200 to 800, or from 200 to 600. Alternatively, the monomeric cyclic amine compound may have a weight average molecular weight of less than 500, or at least 50. In some embodiments, the monomeric cyclic amine compound is free from aromatic groups, such as phenyl and benzyl rings. In other embodiments, the monomeric cyclic amine compound is aliphatic.

The monomeric cyclic amine compound may include two or fewer nitrogen atoms per molecule. Alternatively, the monomeric cyclic amine compound may include only one nitrogen per molecule. The phrase "nitrogen per molecule" refers to the total number of nitrogen atoms in the entire molecule, including the body of the molecule and any substituent groups. In certain embodiments, the monomeric cyclic amine compound includes one or two nitrogen atoms in the cyclic ring of the monomeric cyclic amine compound.

In some embodiments, the amine compound, such as the monomeric acyclic amine compound or the monomeric cyclic amine compound, may be a sterically hindered amine compound. The sterically hindered amine compound may have a weight average molecular weight of from 100 to 1200. Alternatively, the sterically hindered amine compound may have a weight average molecular weight of from 200 to 800, or from 200 to 600. Alternatively still, the sterically hindered amine compound may have a weight average molecular weight of less than 500.

The sterically hindered amine compound may include a single ester group. However, the sterically hindered amine compound may alternatively be free from ester groups. In certain embodiments, the sterically hindered amine compound may include at least one, or only one, piperidine ring.

If employed, the amine compound can be used in various amounts. The amine compound may be present in the additive package in an amount ranging from 0.1 to 50, from 0.1 to 25, from 0.1 to 15, from 0.1 to 10, from 0.1 to 8, or from 1 to 5, wt. %, based on the total weight of the additive package. The dispersant may be present in the lubricant composition in an amount ranging from 0.1 to 25, from 0.1 to 20, from 0.1 to 15, from 0.1 to 10, from 0.5 to 5, from 1 to 3, or from 1 to 2, wt. %, based on the total weight of the lubricant composition.

The present disclosure also provides a method of lubricating an internal combustion engine for improving fuel economy of the internal combustion engine. The method includes providing the lubricant composition. The lubricant composition, as described above, includes the base oil, the alkoxylated amine, the ester, and the anti-wear agent. The method further includes lubricating the internal combustion engine with the lubricant composition.

It is to be appreciated that many changes may be made to the following examples, while still obtaining like or similar results. Accordingly, the following examples, illustrating embodiments of the additive package and resultant lubricant composition of the present disclosure, are intended to illustrate and not to limit the disclosure.

EXAMPLES

Exemplary Method 1 for Formation of the Alkoxylated Amide and Ester

A. Condensation Reaction to Form a Coconut Oil Diethanolamide Mixture

Coconut oil (3.80 kg, 5.78 mol) was added to a reactor and heated to about 130° C. Diethanolamine (DEA) (1.22 kg, 11.6 mol, 2 eq.) was added, and the resulting mixture was maintained at a reaction temperature of about 130° C., with stirring, for an additional 6 hours. The product was a viscous yellow to brown oil (5.01 kg), which was used in the alkoxylation reaction without purification.

The condensation reaction was performed using the following starting materials.

| Common Name | Spec. |
|---|---|
| Coconut oil | 40-50% $C_{12}$<br>15-20% $C_{14}$<br>7-12% $C_{16}$ |
| Diethanolamine | >99% purity |

The molecular weight of the coconut oil was calculated from the saponification value.

B. Amine Catalyzed Alkoxylation

The diethanolamide reaction product of step A (869 g, 2.02 mol) was admixed with an amine catalyst (4.9 g N,N-dimethylethanolamine, 0.06 mol, 0.5 w/w %). The resulting mixture was heated to about 110° C. Propylene oxide (117 g, 2.02 mol, 1.0 eq) was added, and the mixture was stirred for additional 12 hours at the reaction temperature. Unreacted propylene oxide was removed under reduced pressure and/or by flushing with nitrogen gas to yield the reaction product.

The following Scheme illustrates the reactions of steps A and B, and the reaction products present after step B.

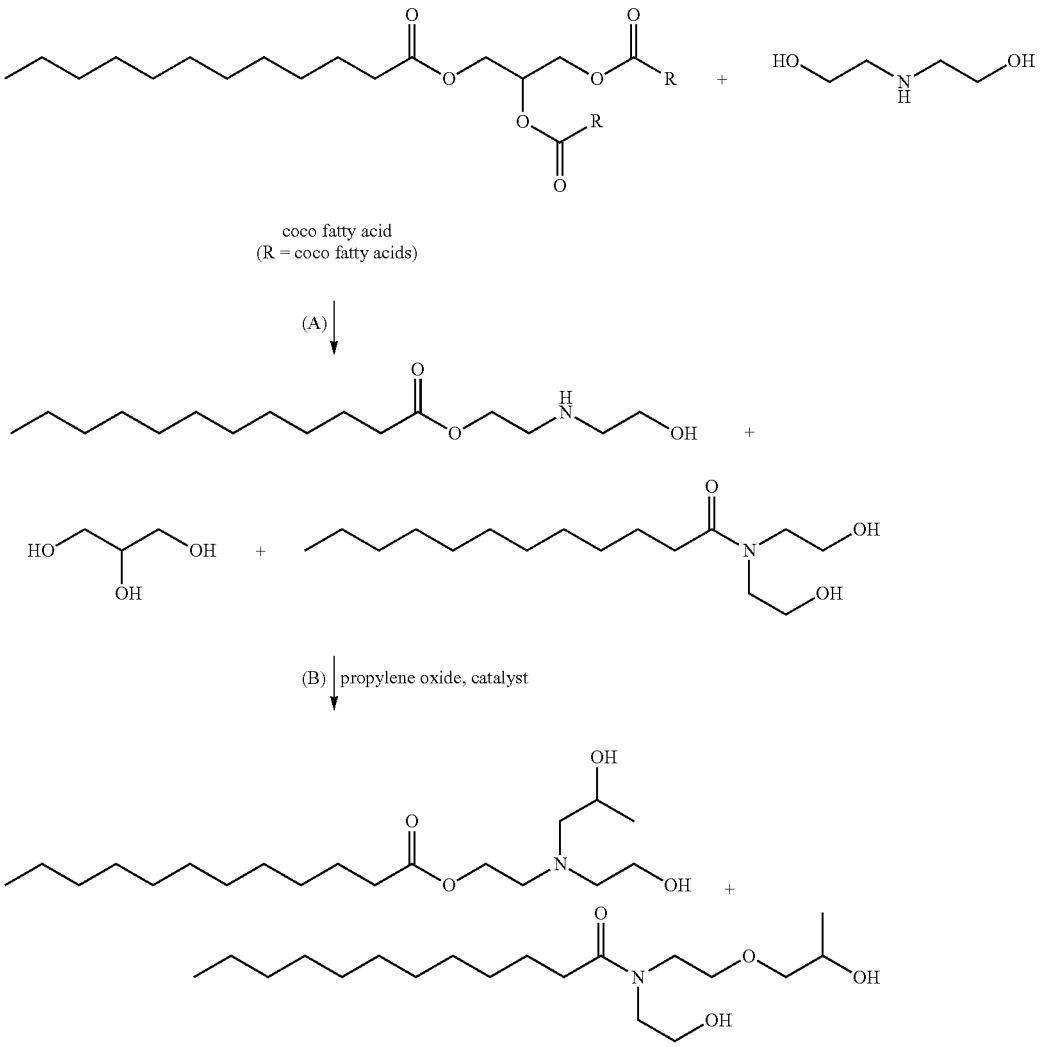

It is noted that an ester also forms in step A, together with the diethanolamide. This ester and unreacted diethanolamine are present during the alkoxylation step B, and may be allowed to remain in the final product. As noted in the above reaction scheme, the ester of step A also was propoxylated. It is further noted that the above Scheme only depicts the main reaction products. The degree of propoxylation is subject to statistic distribution, and further reaction products in minor amounts such as various ethers and heterocycles, e.g., bishydroxyethylpiperazine, as well as residual unreacted compounds, can be found.

Exemplary Method 2 for Formation of the Alkoxylated Amide and Ester

A. Condensation Reaction to Form a Coconut Fatty Acid Diethanolamide Mixture

Coconut fatty acid (3.05 kg, 14.4 mol) was placed in a reactor and heated to about 80° C. Diethanolamine (1.52 kg, 14.4 mol, 1.0 eq.) was added, and the resulting mixture was heated to reaction temperature of about 150° C., then stirred for additional 8 hours. The product was a viscous yellow to brown oil (3.95 kg), which was used in the alkoxylation reaction without further purification.

The condensation reaction was performed using the following starting materials.

| Common Name | Trade Name | Spec. |
|---|---|---|
| Coconut fatty acid | EDENOR K8-18 | 45-53% $C_{12}$<br>17-21% $C_{14}$<br>7-13% $C_{16}$ |
| Diethanolamine | | >99% purity |

The molecular weight of the coconut fatty acid was calculated from the acid number.

B. Amine Catalyzed Alkoxylation Reaction

The diethanolamide reaction product of step A (495 g, 1.72 mol) was admixed with an amine catalyst (3.0 g N,N-dimethylethanolamine, 0.03 mol, 0.5 w/w %). The resulting mixture was heated to about 115° C. Propylene oxide (100 g, 1.72 mol, 1.0 eq) was added and the mixture was stirred for additional 12 hours at about 115° C. Unreacted propylene oxide was removed under reduced pressure and/or by flushing with nitrogen to yield the reaction product.

The following scheme illustrates the reactions of steps A and B, and the reaction products present after step B.

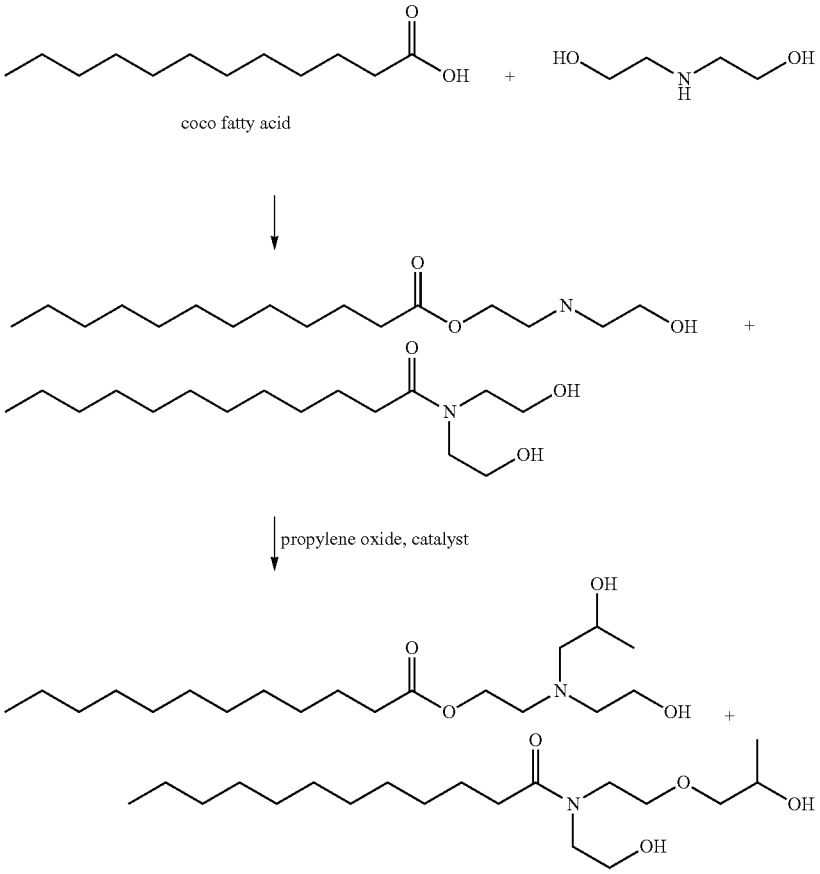

An ester also is formed in step A, together with the diethanolamide. This ester and any unreacted diethanolamine are present during the alkoxylation step B, and may be allowed to remain in the final product. As noted in the above reaction scheme, the ester of step A also was propoxylated. It is further noted that the above Scheme only depicts the main reaction products. The degree of propoxylation is subject to statistic distribution, and further reaction products in minor amounts such as various ethers and heterocycles, e.g., bishydroxyethylpiperazine, as well as residual unreacted compounds, can be found.

Evaluation of Lubricant Compositions Including the Base Oil, the Alkoxylated Amide, the Ester, and the Anti-Wear Agent

A. Friction Coefficient and Ball Scar Diameter Evaluation I

The friction coefficient and the ball scar diameter for lubricant compositions including a base oil, the alkoxylated amide, the ester, and an anti-wear agent were evaluated. The friction coefficient of the lubricant composition was determined according to a modified ASTM D 6079 method. The modified ASTM D 6079 method utilized a High Frequency Reciprocating Rig (HFRR) for determining the friction coefficient. During the determination, the HFRR reciprocated at 10 Hz with a 1 mm stroke. The determination was conducted at a temperature of 100° C. for duration of 120 minutes with a 400 gram load using standard HFRSSP steel balls. The ball scar diameter of the lubricant composition was determined by a laser profilometer.

Example 1 includes 100 wt. % of a Group II base oil. Examples 2-7 include a mixture of Group II base oil and an antiwear agent containing phosphorous. Examples 8-13 a mixture of the alkoxylated amide and ester in an amount as shown in Table 1, and a Group II base oil. Examples 14-19 include an antiwear agent including phosphorous, a mixture of the alkoxylated amide and ester, and a Group II base oil. Examples 8-19 each also include a minor amount of by-products resulting and reactants remaining from the preparation of the alkoxylated amide of general formula (I) and the ester of general formula (II).

The mixture of alkoxylated amide and ester in Examples 8-19 include the alkoxylated amide and the ester in a weight ratio of 75:25 of the ester to the alkoxylated amide. The anti-wear agent including phosphorous included in Examples 2-7 and 14-19 is zinc dialkyldithiophosphate.

Results of the evaluation are provided in Table 1 below.

TABLE 1

| | Base oil (wt. %) | Anti-wear agent including phosphorous (wt. %) | Mixture of the alkoxylated amide and ester (wt. %) | Friction coefficient of lubricant composition (μ) | Ball scar diameter (μm) |
|---|---|---|---|---|---|
| Example 1 | 100 | — | — | 0.41 | 440 |
| Example 2 | 99.985 | 0.015 | — | 0.22 | 303.5 |
| Example 3 | 99.97 | 0.03 | — | 0.19 | 294 |
| Example 4 | 99.94 | 0.06 | — | 0.22 | 301 |
| Example 5 | 99.92 | 0.08 | — | 0.19 | 300 |
| Example 6 | 99.88 | 0.12 | — | 0.21 | 296 |

TABLE 1-continued

| | Base oil (wt. %) | Anti-wear agent including phosphorous (wt. %) | Mixture of the alkoxylated amide and ester (wt. %) | Friction coefficient of lubricant composition (μ) | Ball scar diameter (μm) |
|---|---|---|---|---|---|
| Example 7 | 99.8 | 0.2 | — | 0.23 | 264.5 |
| Example 8 | 99.97 | — | 0.03 | 0.33 | 302.5 |
| Example 9 | 99.9 | — | 0.1 | 0.16 | 284.5 |
| Example 10 | 99.7 | — | 0.3 | 0.18 | 274.5 |
| Example 11 | 99.4 | — | 0.6 | 0.18 | 285 |
| Example 12 | 99 | — | 1 | 0.18 | 288.5 |
| Example 13 | 98 | — | 2 | 0.17 | 266 |
| Example 14 | 99.92 | 0.08 | 0.03 | 0.22 | 198 |
| Example 15 | 99.92 | 0.08 | 0.1 | 0.15 | 190 |
| Example 16 | 99.92 | 0.08 | 0.3 | 0.17 | 186.5 |
| Example 17 | 99.92 | 0.08 | 0.6 | 0.18 | 186 |
| Example 18 | 99.92 | 0.08 | 1 | 0.18 | 208 |
| Example 19 | 99.92 | 0.08 | 2 | 0.17 | 206.5 |

B. Friction Coefficient and Ball Scar Diameter Evaluation II

The friction coefficient and the ball scar diameter for lubricant compositions including the base oil, the alkoxylated amide, the ester, and the anti-wear agent were further evaluated against lubricant compositions including comparative friction modifiers. The friction coefficient of each of the lubricant compositions was determined according to a modified ASTM D 6079 method. The modified ASTM D 6079 method utilized a High Frequency Reciprocating Rig (HFRR) for determining the friction coefficients. During the determination, the HFRR reciprocated at 10 Hz with a 1 mm stroke. The determination was conducted at a temperature of 100° C. for duration of 120 minutes with a 400 gram load using standard HFRSSP steel balls. The ball scar diameter of each of the lubricant compositions was determined by a laser profilometer.

Examples 20-86 include a Group II base oil (Base oil).

Examples 21-32, 39-44, 51-56, 63-68, and 75-80 further include zinc dialkyldithiophosphate as the anti-wear agent including phosphorous (Anti-wear agent).

Examples 27-38 further include glycerol mono oleate as the ester free of nitrogen (Friction modifier I).

Examples 39-50 further include lauryl amide as the amide free of alkoxylation (Friction modifier II).

Examples 51-62 further include lauryl amide and glycerol mono oleate.

Examples 63-74 further include a mixture of the alkoxylated amide and the ester in a weight ratio of 75:25 of the ester to the alkoxylated amide (Fuel economy agent).

Examples 75-86 further include the mixture of the alkoxylated amide and the ester, and glycerol mono oleate.

Examples 63-86 also include a minor amount of by-products resulting and reactants remaining from the preparation of the alkoxylated amide of general formula (I) and the ester of general formula (II).

Results of the evaluation are provided in Table 2 below.

TABLE 2

| | Base oil (wt. %) | Anti-wear agent (wt. %) | Friction modifier I (wt. %) | Friction modifier II (wt. %) | Fuel economy agent (wt. %) | Friction coefficient (μ) | Ball scar diameter (μm) |
|---|---|---|---|---|---|---|---|
| Ex. 20 | 100 | — | — | — | — | 0.411 | 440 |
| Ex. 21 | 99.985 | 0.015 | — | — | — | 0.22 | 303.5 |
| Ex. 22 | 99.97 | 0.03 | — | — | — | 0.19 | 294 |
| Ex. 23 | 99.94 | 0.06 | — | — | — | 0.22 | 301 |
| Ex. 24 | 99.92 | 0.08 | — | — | — | 0.221 | 303 |
| Ex. 25 | 99.88 | 0.12 | — | — | — | 0.21 | 296 |
| Ex. 26 | 99.8 | 0.2 | — | — | — | 0.23 | 264.5 |
| Ex. 27 | 99.89 | 0.08 | 0.03 | — | — | 0.154 | 236 |
| Ex. 28 | 99.82 | 0.08 | 0.1 | — | — | 0.161 | 259 |
| Ex. 29 | 99.62 | 0.08 | 0.3 | — | — | 0.134 | 168 |
| Ex. 30 | 99.32 | 0.08 | 0.6 | — | — | 0.12 | 155 |
| Ex. 31 | 98.92 | 0.08 | 1 | — | — | 0.118 | 157 |
| Ex. 32 | 97.92 | 0.08 | 2 | — | — | 0.135 | 168 |
| Ex. 33 | 99.97 | — | 0.03 | — | — | 0.168 | 229 |
| Ex. 34 | 99.9 | — | 0.1 | — | — | 0.13 | 206 |
| Ex. 35 | 99.7 | — | 0.3 | — | — | 0.106 | 209 |
| Ex. 36 | 99.4 | — | 0.6 | — | — | 0.112 | 203 |
| Ex. 37 | 99 | — | 1 | — | — | 0.115 | 199 |
| Ex. 38 | 98 | — | 2 | — | — | 0.119 | 185 |
| Ex. 39 | 99.89 | 0.08 | — | 0.03 | — | 0.15 | 135 |
| Ex. 40 | 99.82 | 0.08 | — | 0.1 | — | 0.15 | 165 |
| Ex. 41 | 99.62 | 0.08 | — | 0.3 | — | 0.15 | 184 |
| Ex. 42 | 99.32 | 0.08 | — | 0.6 | — | 0.16 | 194 |
| Ex. 43 | 98.92 | 0.08 | — | 1 | — | 0.16 | 169 |
| Ex. 44 | 97.92 | 0.08 | — | 2 | — | 0.17 | 172 |
| Ex. 45 | 99.97 | — | — | 0.03 | — | 0.16 | 237 |
| Ex. 46 | 99.9 | — | — | 0.1 | — | 0.17 | 256 |
| Ex. 47 | 99.7 | — | — | 0.3 | — | 0.16 | 257 |
| Ex. 48 | 99.4 | — | — | 0.6 | — | 0.16 | 271 |
| Ex. 49 | 99 | — | — | 1 | — | 0.17 | 258 |
| Ex. 50 | 98 | — | — | 2 | — | 0.16 | 252 |
| Ex. 51 | 99.89 | 0.08 | 0.015 | 0.015 | — | 0.154 | 212 |
| Ex. 52 | 99.82 | 0.08 | 0.05 | 0.05 | — | 0.157 | 168 |
| Ex. 53 | 99.62 | 0.08 | 0.15 | 0.15 | — | 0.145 | 189 |
| Ex. 54 | 99.32 | 0.08 | 0.3 | 0.3 | — | 0.147 | 181 |
| Ex. 55 | 98.92 | 0.08 | 0.5 | 0.5 | — | 0.142 | 176 |
| Ex. 56 | 97.92 | 0.08 | 1 | 1 | — | 0.141 | 172 |
| Ex. 57 | 99.97 | — | 0.015 | 0.015 | — | 0.188 | 238 |
| Ex. 58 | 99.9 | — | 0.05 | 0.05 | — | 0.160 | 231 |
| Ex. 59 | 99.7 | — | 0.15 | 0.15 | — | 0.169 | 243 |

TABLE 2-continued

| | Base oil (wt. %) | Anti-wear agent (wt. %) | Friction modifier I (wt. %) | Friction modifier II (wt. %) | Fuel economy agent (wt. %) | Friction coefficient (μ) | Ball scar diameter (μm) |
|---|---|---|---|---|---|---|---|
| Ex. 60 | 99.4 | — | 0.3 | 0.3 | — | 0.148 | 218 |
| Ex. 61 | 99 | — | 0.5 | 0.5 | — | 0.148 | 206 |
| Ex. 62 | 98 | — | 1 | 1 | — | 0.140 | 200 |
| Ex. 63 | 99.89 | 0.08 | — | — | 0.03 | 0.22 | 198 |
| Ex. 64 | 99.82 | 0.08 | — | — | 0.1 | 0.15 | 190 |
| Ex. 65 | 99.62 | 0.08 | — | — | 0.3 | 0.17 | 186.5 |
| Ex. 66 | 99.32 | 0.08 | — | — | 0.6 | 0.18 | 186 |
| Ex. 67 | 98.92 | 0.08 | — | — | 1 | 0.18 | 208 |
| Ex. 68 | 97.92 | 0.08 | — | — | 2 | 0.17 | 206.5 |
| Ex. 69 | 99.97 | — | — | — | 0.03 | 0.33 | 302.5 |
| Ex. 70 | 99.9 | — | — | — | 0.1 | 0.16 | 284.5 |
| Ex. 71 | 99.7 | — | — | — | 0.3 | 0.18 | 274.5 |
| Ex. 72 | 99.4 | — | — | — | 0.6 | 0.18 | 285 |
| Ex. 73 | 99 | — | — | — | 1 | 0.18 | 288.5 |
| Ex. 74 | 98 | — | — | — | 2 | 0.17 | 266 |
| Ex. 75 | 99.89 | 0.08 | 0.015 | — | 0.015 | 0.151 | 193 |
| Ex. 76 | 99.82 | 0.08 | 0.05 | — | 0.05 | 0.154 | 171 |
| Ex. 77 | 99.62 | 0.08 | 0.15 | — | 0.15 | 0.158 | 186 |
| Ex. 78 | 99.32 | 0.08 | 0.3 | — | 0.3 | 0.161 | 182 |
| Ex. 79 | 98.92 | 0.08 | 0.5 | — | 0.5 | 0.165 | 180 |
| Ex. 80 | 97.92 | 0.08 | 1 | — | 1 | 0.158 | 192 |
| Ex. 81 | 99.97 | — | 0.015 | — | 0.015 | 0.155 | 225 |
| Ex. 82 | 99.9 | — | 0.05 | — | 0.05 | 0.158 | 258 |
| Ex. 83 | 99.7 | — | 0.15 | — | 0.15 | 0.158 | 233 |
| Ex. 84 | 99.4 | — | 0.3 | — | 0.3 | 0.160 | 228 |
| Ex. 85 | 99 | — | 0.5 | — | 0.5 | 0.149 | 212 |
| Ex. 86 | 98 | — | 1 | — | 1 | 0.146 | 184 |

C. Traction Coefficient Evaluation

The traction coefficients for lubricant compositions including the base oil, the alkoxylated amide, the ester, and the anti-wear agent were evaluated against lubricant compositions including a comparative friction modifier. The traction coefficient of each of the lubricant compositions was determined by utilizing a Mini-Traction Machine (MTM), specifically MTM 2 from PCS Instruments. During the determination, standard steel ball (19.05 mm) and discs (46 mm) were utilized in the MTM, the load of the MTM was set to 1 GPa, and the lubricant compositions were pre-heated to 125° C. The traction coefficient of each of the lubricant compositions was measured from speeds between 0 and 2000 mm/s utilizing a 25% slide/roll ratio.

Examples 87-314 include a Group II base oil (Base oil).

Examples 315-428 include a Group II base oil with an additive package including a dispersant, an antioxidant, a detergent, a pour point depressant, and a viscosity modifier (Base oil with additive package).

Examples 201-428 further include zinc dialkyldithiophosphate as the anti-wear agent including phosphorous (Anti-wear agent).

Examples 125-162, 239-276, and 353-390 further include glycerol mono oleate as the ester free of nitrogen (Friction modifier I).

Examples 163-200, 277-314, and 391-428 further include a mixture of the alkoxylated amide and the ester in a weight ratio of 75:25 of the ester to the alkoxylated amide (Fuel economy agent).

Examples 163-200, 277-314, and 391-428 also include a minor amount of by-products resulting and reactants remaining from the preparation of the alkoxylated amide of general formula (I) and the ester of general formula (II).

Results of the evaluation are provided in Table 3 below and graphically in FIG. 1.

TABLE 3

| | Base oil (wt. %) | Base oil with additive package (wt. %) | Anti-wear agent (wt. %) | Friction modifier I (wt. %) | Fuel economy agent (wt. %) | Rolling Speed (mm/s) | Traction Coeff. |
|---|---|---|---|---|---|---|---|
| Ex. 87 | 100 | — | — | — | — | 0.962 | 0.0158 |
| Ex. 88 | 100 | — | — | — | — | 1.677 | 0.1029 |
| Ex. 89 | 100 | — | — | — | — | 3.013 | 0.1033 |
| Ex. 90 | 100 | — | — | — | — | 3.8 | 0.10433 |
| Ex. 91 | 100 | — | — | — | — | 5.115 | 0.1078 |
| Ex. 92 | 100 | — | — | — | — | 5.405 | 0.1162 |
| Ex. 93 | 100 | — | — | — | — | 7.042 | 0.1104 |
| Ex. 94 | 100 | — | — | — | — | 7.929 | 0.1184 |
| Ex. 95 | 100 | — | — | — | — | 9.056 | 0.1102 |
| Ex. 96 | 100 | — | — | — | — | 9.667 | 0.1166 |
| Ex. 97 | 100 | — | — | — | — | 19.897 | 0.0847 |
| Ex. 98 | 100 | — | — | — | — | 30.435 | 0.0811 |
| Ex. 99 | 100 | — | — | — | — | 39.999 | 0.074 |
| Ex. 100 | 100 | — | — | — | — | 50.195 | 0.0601 |
| Ex. 101 | 100 | — | — | — | — | 59.658 | 0.0625 |

TABLE 3-continued

| | Base oil (wt. %) | Base oil with additive package (wt. %) | Anti-wear agent (wt. %) | Friction modifier I (wt. %) | Fuel economy agent (wt. %) | Rolling Speed (mm/s) | Traction Coeff. |
|---|---|---|---|---|---|---|---|
| Ex. 102 | 100 | — | — | — | — | 70.085 | 0.0622 |
| Ex. 103 | 100 | — | — | — | — | 80.296 | 0.0582 |
| Ex. 104 | 100 | — | — | — | — | 89.799 | 0.0568 |
| Ex. 105 | 100 | — | — | — | — | 100.296 | 0.0586 |
| Ex. 106 | 100 | — | — | — | — | 200.254 | 0.0457 |
| Ex. 107 | 100 | — | — | — | — | 299.662 | 0.0391 |
| Ex. 108 | 100 | — | — | — | — | 400.033 | 0.0346 |
| Ex. 109 | 100 | — | — | — | — | 500.059 | 0.0309 |
| Ex. 110 | 100 | — | — | — | — | 600.25 | 0.0276 |
| Ex. 111 | 100 | — | — | — | — | 699.664 | 0.0257 |
| Ex. 112 | 100 | — | — | — | — | 799.768 | 0.0245 |
| Ex. 113 | 100 | — | — | — | — | 900.358 | 0.0234 |
| Ex. 114 | 100 | — | — | — | — | 1000.968 | 0.0223 |
| Ex. 115 | 100 | — | — | — | — | 1100.521 | 0.0214 |
| Ex. 116 | 100 | — | — | — | — | 1200.297 | 0.0206 |
| Ex. 117 | 100 | — | — | — | — | 1299.564 | 0.0198 |
| Ex. 118 | 100 | — | — | — | — | 1400.009 | 0.0191 |
| Ex. 119 | 100 | — | — | — | — | 1500.357 | 0.0187 |
| Ex. 120 | 100 | — | — | — | — | 1600.239 | 0.0182 |
| Ex. 121 | 100 | — | — | — | — | 1700.373 | 0.0178 |
| Ex. 122 | 100 | — | — | — | — | 1799.935 | 0.0174 |
| Ex. 123 | 100 | — | — | — | — | 1900.163 | 0.0171 |
| Ex. 124 | 100 | — | — | — | — | 1999.889 | 0.0168 |
| Ex. 125 | 99.5 | — | — | 0.5 | — | 0.949 | −0.0016 |
| Ex. 126 | 99.5 | — | — | 0.5 | — | 1.989 | 0.05 |
| Ex. 127 | 99.5 | — | — | 0.5 | — | 2.882 | 0.0998 |
| Ex. 128 | 99.5 | — | — | 0.5 | — | 3.891 | 0.088 |
| Ex. 129 | 99.5 | — | — | 0.5 | — | 5.193 | 0.0951 |
| Ex. 130 | 99.5 | — | — | 0.5 | — | 6.147 | 0.0929 |
| Ex. 131 | 99.5 | — | — | 0.5 | — | 7.01 | 0.0872 |
| Ex. 132 | 99.5 | — | — | 0.5 | — | 8.011 | 0.0849 |
| Ex. 133 | 99.5 | — | — | 0.5 | — | 9.461 | 0.0823 |
| Ex. 134 | 99.5 | — | — | 0.5 | — | 9.984 | 0.0785 |
| Ex. 135 | 99.5 | — | — | 0.5 | — | 19.664 | 0.0778 |
| Ex. 136 | 99.5 | — | — | 0.5 | — | 29.561 | 0.0659 |
| Ex. 137 | 99.5 | — | — | 0.5 | — | 39.263 | 0.064 |
| Ex. 138 | 99.5 | — | — | 0.5 | — | 49.865 | 0.0628 |
| Ex. 139 | 99.5 | — | — | 0.5 | — | 59.777 | 0.0591 |
| Ex. 140 | 99.5 | — | — | 0.5 | — | 69.944 | 0.055 |
| Ex. 141 | 99.5 | — | — | 0.5 | — | 81.048 | 0.0552 |
| Ex. 142 | 99.5 | — | — | 0.5 | — | 90.596 | 0.0541 |
| Ex. 143 | 99.5 | — | — | 0.5 | — | 99.734 | 0.0537 |
| Ex. 144 | 99.5 | — | — | 0.5 | — | 200.362 | 0.0505 |
| Ex. 145 | 99.5 | — | — | 0.5 | — | 300.581 | 0.0459 |
| Ex. 146 | 99.5 | — | — | 0.5 | — | 399.704 | 0.0405 |
| Ex. 147 | 99.5 | — | — | 0.5 | — | 500.203 | 0.0297 |
| Ex. 148 | 99.5 | — | — | 0.5 | — | 600.131 | 0.026 |
| Ex. 149 | 99.5 | — | — | 0.5 | — | 700.143 | 0.023 |
| Ex. 150 | 99.5 | — | — | 0.5 | — | 800.486 | 0.0211 |
| Ex. 151 | 99.5 | — | — | 0.5 | — | 899.639 | 0.0197 |
| Ex. 152 | 99.5 | — | — | 0.5 | — | 1000.152 | 0.0186 |
| Ex. 153 | 99.5 | — | — | 0.5 | — | 1099.66 | 0.0182 |
| Ex. 154 | 99.5 | — | — | 0.5 | — | 1199.611 | 0.0177 |
| Ex. 155 | 99.5 | — | — | 0.5 | — | 1300.467 | 0.0172 |
| Ex. 156 | 99.5 | — | — | 0.5 | — | 1400.157 | 0.0167 |
| Ex. 157 | 99.5 | — | — | 0.5 | — | 1500.177 | 0.0163 |
| Ex. 158 | 99.5 | — | — | 0.5 | — | 1600.206 | 0.016 |
| Ex. 159 | 99.5 | — | — | 0.5 | — | 1699.844 | 0.0158 |
| Ex. 160 | 99.5 | — | — | 0.5 | — | 1799.844 | 0.0156 |
| Ex. 161 | 99.5 | — | — | 0.5 | — | 1899.764 | 0.0153 |
| Ex. 162 | 99.5 | — | — | 0.5 | — | 2000.249 | 0.0151 |
| Ex. 163 | 99.5 | — | — | — | 0.5 | 1.092 | 0.011 |
| Ex. 164 | 99.5 | — | — | — | 0.5 | 1.934 | 0.03 |
| Ex. 165 | 99.5 | — | — | — | 0.5 | 2.961 | 0.0595 |
| Ex. 166 | 99.5 | — | — | — | 0.5 | 4.092 | 0.0552 |
| Ex. 167 | 99.5 | — | — | — | 0.5 | 4.815 | 0.0757 |
| Ex. 168 | 99.5 | — | — | — | 0.5 | 6.335 | 0.0746 |
| Ex. 169 | 99.5 | — | — | — | 0.5 | 7.213 | 0.0734 |
| Ex. 170 | 99.5 | — | — | — | 0.5 | 8.136 | 0.0702 |
| Ex. 171 | 99.5 | — | — | — | 0.5 | 9.169 | 0.0708 |
| Ex. 172 | 99.5 | — | — | — | 0.5 | 10.071 | 0.0729 |
| Ex. 173 | 99.5 | — | — | — | 0.5 | 20.335 | 0.068 |
| Ex. 174 | 99.5 | — | — | — | 0.5 | 30.159 | 0.0648 |
| Ex. 175 | 99.5 | — | — | — | 0.5 | 40.4 | 0.062 |
| Ex. 176 | 99.5 | — | — | — | 0.5 | 49.618 | 0.0557 |

TABLE 3-continued

| | Base oil (wt. %) | Base oil with additive package (wt. %) | Anti-wear agent (wt. %) | Friction modifier I (wt. %) | Fuel economy agent (wt. %) | Rolling Speed (mm/s) | Traction Coeff. |
|---|---|---|---|---|---|---|---|
| Ex. 177 | 99.5 | — | — | — | 0.5 | 60.643 | 0.0523 |
| Ex. 178 | 99.5 | — | — | — | 0.5 | 70.061 | 0.0516 |
| Ex. 179 | 99.5 | — | — | — | 0.5 | 78.409 | 0.0473 |
| Ex. 180 | 99.5 | — | — | — | 0.5 | 89.589 | 0.0446 |
| Ex. 181 | 99.5 | — | — | — | 0.5 | 100.523 | 0.042 |
| Ex. 182 | 99.5 | — | — | — | 0.5 | 200.258 | 0.0272 |
| Ex. 183 | 99.5 | — | — | — | 0.5 | 300.799 | 0.0222 |
| Ex. 184 | 99.5 | — | — | — | 0.5 | 399.724 | 0.0204 |
| Ex. 185 | 99.5 | — | — | — | 0.5 | 500.002 | 0.0193 |
| Ex. 186 | 99.5 | — | — | — | 0.5 | 600.839 | 0.0187 |
| Ex. 187 | 99.5 | — | — | — | 0.5 | 700.435 | 0.0182 |
| Ex. 188 | 99.5 | — | — | — | 0.5 | 799.378 | 0.0176 |
| Ex. 189 | 99.5 | — | — | — | 0.5 | 899.755 | 0.0173 |
| Ex. 190 | 99.5 | — | — | — | 0.5 | 1000.626 | 0.0168 |
| Ex. 191 | 99.5 | — | — | — | 0.5 | 1100.092 | 0.0165 |
| Ex. 192 | 99.5 | — | — | — | 0.5 | 1200.543 | 0.0162 |
| Ex. 193 | 99.5 | — | — | — | 0.5 | 1299.109 | 0.0159 |
| Ex. 194 | 99.5 | — | — | — | 0.5 | 1400.676 | 0.0156 |
| Ex. 195 | 99.5 | — | — | — | 0.5 | 1499.969 | 0.0154 |
| Ex. 196 | 99.5 | — | — | — | 0.5 | 1600.312 | 0.0152 |
| Ex. 197 | 99.5 | — | — | — | 0.5 | 1699.875 | 0.0151 |
| Ex. 198 | 99.5 | — | — | — | 0.5 | 1799.9 | 0.0149 |
| Ex. 199 | 99.5 | — | — | — | 0.5 | 1899.832 | 0.0148 |
| Ex. 200 | 99.5 | — | — | — | 0.5 | 1999.948 | 0.0147 |
| Ex. 201 | 99.92 | — | 0.08 | — | — | 0.998 | −0.0382 |
| Ex. 202 | 99.92 | — | 0.08 | — | — | 1.981 | 0.0433 |
| Ex. 203 | 99.92 | — | 0.08 | — | — | 3.09 | 0.0114 |
| Ex. 204 | 99.92 | — | 0.08 | — | — | 4.067 | 0.0745 |
| Ex. 205 | 99.92 | — | 0.08 | — | — | 5.155 | 0.1139 |
| Ex. 206 | 99.92 | — | 0.08 | — | — | 5.823 | 0.1137 |
| Ex. 207 | 99.92 | — | 0.08 | — | — | 6.766 | 0.115 |
| Ex. 208 | 99.92 | — | 0.08 | — | — | 8.003 | 0.1113 |
| Ex. 209 | 99.92 | — | 0.08 | — | — | 8.949 | 0.1191 |
| Ex. 210 | 99.92 | — | 0.08 | — | — | 9.94 | 0.1195 |
| Ex. 211 | 99.92 | — | 0.08 | — | — | 19.993 | 0.1121 |
| Ex. 212 | 99.92 | — | 0.08 | — | — | 29.823 | 0.1099 |
| Ex. 213 | 99.92 | — | 0.08 | — | — | 39.196 | 0.1104 |
| Ex. 214 | 99.92 | — | 0.08 | — | — | 49.696 | 0.107 |
| Ex. 215 | 99.92 | — | 0.08 | — | — | 60.12 | 0.1057 |
| Ex. 216 | 99.92 | — | 0.08 | — | — | 69.925 | 0.1022 |
| Ex. 217 | 99.92 | — | 0.08 | — | — | 79.972 | 0.1022 |
| Ex. 218 | 99.92 | — | 0.08 | — | — | 89.122 | 0.0992 |
| Ex. 219 | 99.92 | — | 0.08 | — | — | 99.381 | 0.0999 |
| Ex. 220 | 99.92 | — | 0.08 | — | — | 199.857 | 0.0866 |
| Ex. 221 | 99.92 | — | 0.08 | — | — | 300.272 | 0.0801 |
| Ex. 222 | 99.92 | — | 0.08 | — | — | 400.761 | 0.0709 |
| Ex. 223 | 99.92 | — | 0.08 | — | — | 500.016 | 0.0625 |
| Ex. 224 | 99.92 | — | 0.08 | — | — | 600.159 | 0.0582 |
| Ex. 225 | 99.92 | — | 0.08 | — | — | 700.005 | 0.0561 |
| Ex. 226 | 99.92 | — | 0.08 | — | — | 799.183 | 0.055 |
| Ex. 227 | 99.92 | — | 0.08 | — | — | 900.07 | 0.0541 |
| Ex. 228 | 99.92 | — | 0.08 | — | — | 1000.144 | 0.0534 |
| Ex. 229 | 99.92 | — | 0.08 | — | — | 1100.143 | 0.0529 |
| Ex. 230 | 99.92 | — | 0.08 | — | — | 1199.947 | 0.0525 |
| Ex. 231 | 99.92 | — | 0.08 | — | — | 1299.983 | 0.0521 |
| Ex. 232 | 99.92 | — | 0.08 | — | — | 1400.134 | 0.0516 |
| Ex. 233 | 99.92 | — | 0.08 | — | — | 1499.927 | 0.0514 |
| Ex. 234 | 99.92 | — | 0.08 | — | — | 1599.967 | 0.0509 |
| Ex. 235 | 99.92 | — | 0.08 | — | — | 1699.728 | 0.0506 |
| Ex. 236 | 99.92 | — | 0.08 | — | — | 1799.952 | 0.0506 |
| Ex. 237 | 99.92 | — | 0.08 | — | — | 1899.795 | 0.0501 |
| Ex. 238 | 99.92 | — | 0.08 | — | — | 2000.191 | 0.0493 |
| Ex. 239 | 99.42 | — | 0.08 | 0.5 | — | 0.968 | 0.0128 |
| Ex. 240 | 99.42 | — | 0.08 | 0.5 | — | 2.082 | 0.06 |
| Ex. 241 | 99.42 | — | 0.08 | 0.5 | — | 2.951 | 0.06 |
| Ex. 242 | 99.42 | — | 0.08 | 0.5 | — | 3.543 | 0.0613 |
| Ex. 243 | 99.42 | — | 0.08 | 0.5 | — | 4.822 | 0.072 |
| Ex. 244 | 99.42 | — | 0.08 | 0.5 | — | 5.747 | 0.0631 |
| Ex. 245 | 99.42 | — | 0.08 | 0.5 | — | 7.162 | 0.0596 |
| Ex. 246 | 99.42 | — | 0.08 | 0.5 | — | 7.964 | 0.0726 |
| Ex. 247 | 99.42 | — | 0.08 | 0.5 | — | 9.393 | 0.0653 |
| Ex. 248 | 99.42 | — | 0.08 | 0.5 | — | 10.077 | 0.0623 |
| Ex. 249 | 99.42 | — | 0.08 | 0.5 | — | 19.795 | 0.0514 |
| Ex. 250 | 99.42 | — | 0.08 | 0.5 | — | 30.625 | 0.0474 |
| Ex. 251 | 99.42 | — | 0.08 | 0.5 | — | 39.887 | 0.0462 |

TABLE 3-continued

| | Base oil (wt. %) | Base oil with additive package (wt. %) | Anti-wear agent (wt. %) | Friction modifier I (wt. %) | Fuel economy agent (wt. %) | Rolling Speed (mm/s) | Traction Coeff. |
|---|---|---|---|---|---|---|---|
| Ex. 252 | 99.42 | — | 0.08 | 0.5 | — | 49.646 | 0.046 |
| Ex. 253 | 99.42 | — | 0.08 | 0.5 | — | 59.844 | 0.0436 |
| Ex. 254 | 99.42 | — | 0.08 | 0.5 | — | 69.66 | 0.0416 |
| Ex. 255 | 99.42 | — | 0.08 | 0.5 | — | 79.606 | 0.0403 |
| Ex. 256 | 99.42 | — | 0.08 | 0.5 | — | 89.916 | 0.0414 |
| Ex. 257 | 99.42 | — | 0.08 | 0.5 | — | 101.33 | 0.042 |
| Ex. 258 | 99.42 | — | 0.08 | 0.5 | — | 199.705 | 0.0451 |
| Ex. 259 | 99.42 | — | 0.08 | 0.5 | — | 300.217 | 0.0447 |
| Ex. 260 | 99.42 | — | 0.08 | 0.5 | — | 400.016 | 0.0431 |
| Ex. 261 | 99.42 | — | 0.08 | 0.5 | — | 499.984 | 0.04 |
| Ex. 262 | 99.42 | — | 0.08 | 0.5 | — | 600.592 | 0.0372 |
| Ex. 263 | 99.42 | — | 0.08 | 0.5 | — | 700.426 | 0.0344 |
| Ex. 264 | 99.42 | — | 0.08 | 0.5 | — | 799.998 | 0.0319 |
| Ex. 265 | 99.42 | — | 0.08 | 0.5 | — | 899.399 | 0.0294 |
| Ex. 266 | 99.42 | — | 0.08 | 0.5 | — | 999.906 | 0.0272 |
| Ex. 267 | 99.42 | — | 0.08 | 0.5 | — | 1100.165 | 0.0246 |
| Ex. 268 | 99.42 | — | 0.08 | 0.5 | — | 1199.845 | 0.0221 |
| Ex. 269 | 99.42 | — | 0.08 | 0.5 | — | 1299.45 | 0.0208 |
| Ex. 270 | 99.42 | — | 0.08 | 0.5 | — | 1399.648 | 0.0198 |
| Ex. 271 | 99.42 | — | 0.08 | 0.5 | — | 1500.139 | 0.019 |
| Ex. 272 | 99.42 | — | 0.08 | 0.5 | — | 1599.762 | 0.0183 |
| Ex. 273 | 99.42 | — | 0.08 | 0.5 | — | 1699.628 | 0.0178 |
| Ex. 274 | 99.42 | — | 0.08 | 0.5 | — | 1800.018 | 0.0172 |
| Ex. 275 | 99.42 | — | 0.08 | 0.5 | — | 1900.062 | 0.017 |
| Ex. 276 | 99.42 | — | 0.08 | 0.5 | — | 1999.752 | 0.0166 |
| Ex. 277 | 99.42 | — | 0.08 | — | 0.5 | 1.01 | −0.0295 |
| Ex. 278 | 99.42 | — | 0.08 | — | 0.5 | 2.139 | 0.0503 |
| Ex. 279 | 99.42 | — | 0.08 | — | 0.5 | 3.01 | 0.06 |
| Ex. 280 | 99.42 | — | 0.08 | — | 0.5 | 3.517 | 0.1155 |
| Ex. 281 | 99.42 | — | 0.08 | — | 0.5 | 5.01 | 0.1313 |
| Ex. 282 | 99.42 | — | 0.08 | — | 0.5 | 6.098 | 0.1264 |
| Ex. 283 | 99.42 | — | 0.08 | — | 0.5 | 7.166 | 0.1084 |
| Ex. 284 | 99.42 | — | 0.08 | — | 0.5 | 8.218 | 0.1347 |
| Ex. 285 | 99.42 | — | 0.08 | — | 0.5 | 8.971 | 0.1227 |
| Ex. 286 | 99.42 | — | 0.08 | — | 0.5 | 9.661 | 0.126 |
| Ex. 287 | 99.42 | — | 0.08 | — | 0.5 | 19.994 | 0.1077 |
| Ex. 288 | 99.42 | — | 0.08 | — | 0.5 | 30.248 | 0.0892 |
| Ex. 289 | 99.42 | — | 0.08 | — | 0.5 | 39.726 | 0.0851 |
| Ex. 290 | 99.42 | — | 0.08 | — | 0.5 | 50.022 | 0.0769 |
| Ex. 291 | 99.42 | — | 0.08 | — | 0.5 | 60.777 | 0.07 |
| Ex. 292 | 99.42 | — | 0.08 | — | 0.5 | 70.601 | 0.0691 |
| Ex. 293 | 99.42 | — | 0.08 | — | 0.5 | 80.435 | 0.0632 |
| Ex. 294 | 99.42 | — | 0.08 | — | 0.5 | 90.376 | 0.0573 |
| Ex. 295 | 99.42 | — | 0.08 | — | 0.5 | 98.829 | 0.0578 |
| Ex. 296 | 99.42 | — | 0.08 | — | 0.5 | 200.266 | 0.0384 |
| Ex. 297 | 99.42 | — | 0.08 | — | 0.5 | 299.232 | 0.0294 |
| Ex. 298 | 99.42 | — | 0.08 | — | 0.5 | 400.699 | 0.0244 |
| Ex. 299 | 99.42 | — | 0.08 | — | 0.5 | 499.802 | 0.0213 |
| Ex. 300 | 99.42 | — | 0.08 | — | 0.5 | 599.696 | 0.0195 |
| Ex. 301 | 99.42 | — | 0.08 | — | 0.5 | 700.453 | 0.0182 |
| Ex. 302 | 99.42 | — | 0.08 | — | 0.5 | 799.721 | 0.0172 |
| Ex. 303 | 99.42 | — | 0.08 | — | 0.5 | 900.499 | 0.0166 |
| Ex. 304 | 99.42 | — | 0.08 | — | 0.5 | 999.852 | 0.0161 |
| Ex. 305 | 99.42 | — | 0.08 | — | 0.5 | 1099.712 | 0.0156 |
| Ex. 306 | 99.42 | — | 0.08 | — | 0.5 | 1199.554 | 0.0153 |
| Ex. 307 | 99.42 | — | 0.08 | — | 0.5 | 1299.555 | 0.0151 |
| Ex. 308 | 99.42 | — | 0.08 | — | 0.5 | 1400.34 | 0.0148 |
| Ex. 309 | 99.42 | — | 0.08 | — | 0.5 | 1500.271 | 0.0146 |
| Ex. 310 | 99.42 | — | 0.08 | — | 0.5 | 1599.869 | 0.0144 |
| Ex. 311 | 99.42 | — | 0.08 | — | 0.5 | 1699.814 | 0.0142 |
| Ex. 312 | 99.42 | — | 0.08 | — | 0.5 | 1800.113 | 0.014 |
| Ex. 313 | 99.42 | — | 0.08 | — | 0.5 | 1899.877 | 0.014 |
| Ex. 314 | 99.42 | — | 0.08 | — | 0.5 | 2000.132 | 0.014 |
| Ex. 315 | — | 99.92 | 0.08 | — | — | 0.995 | −0.0266 |
| Ex. 316 | — | 99.92 | 0.08 | — | — | 2.126 | 0.0419 |
| Ex. 317 | — | 99.92 | 0.08 | — | — | 3.029 | −0.0178 |
| Ex. 318 | — | 99.92 | 0.08 | — | — | 4.486 | 0.0436 |
| Ex. 319 | — | 99.92 | 0.08 | — | — | 4.549 | 0.072 |
| Ex. 320 | — | 99.92 | 0.08 | — | — | 5.818 | 0.1085 |
| Ex. 321 | — | 99.92 | 0.08 | — | — | 6.79 | 0.115 |
| Ex. 322 | — | 99.92 | 0.08 | — | — | 8.098 | 0.1076 |
| Ex. 323 | — | 99.92 | 0.08 | — | — | 8.928 | 0.105 |
| Ex. 324 | — | 99.92 | 0.08 | — | — | 10.136 | 0.1055 |
| Ex. 325 | — | 99.92 | 0.08 | — | — | 19.869 | 0.0984 |
| Ex. 326 | — | 99.92 | 0.08 | — | — | 29.702 | 0.078 |

TABLE 3-continued

| | Base oil (wt. %) | Base oil with additive package (wt. %) | Anti-wear agent (wt. %) | Friction modifier I (wt. %) | Fuel economy agent (wt. %) | Rolling Speed (mm/s) | Traction Coeff. |
|---|---|---|---|---|---|---|---|
| Ex. 327 | — | 99.92 | 0.08 | — | — | 39.919 | 0.0766 |
| Ex. 328 | — | 99.92 | 0.08 | — | — | 50.076 | 0.0752 |
| Ex. 329 | — | 99.92 | 0.08 | — | — | 60.442 | 0.072 |
| Ex. 330 | — | 99.92 | 0.08 | — | — | 69.47 | 0.0697 |
| Ex. 331 | — | 99.92 | 0.08 | — | — | 79.842 | 0.0697 |
| Ex. 332 | — | 99.92 | 0.08 | — | — | 90.06 | 0.0673 |
| Ex. 333 | — | 99.92 | 0.08 | — | — | 99.358 | 0.0665 |
| Ex. 334 | — | 99.92 | 0.08 | — | — | 201.009 | 0.0543 |
| Ex. 335 | — | 99.92 | 0.08 | — | — | 300.042 | 0.0476 |
| Ex. 336 | — | 99.92 | 0.08 | — | — | 401.2 | 0.0434 |
| Ex. 337 | — | 99.92 | 0.08 | — | — | 499.924 | 0.0404 |
| Ex. 338 | — | 99.92 | 0.08 | — | — | 599.516 | 0.038 |
| Ex. 339 | — | 99.92 | 0.08 | — | — | 699.622 | 0.0358 |
| Ex. 340 | — | 99.92 | 0.08 | — | — | 800.535 | 0.0339 |
| Ex. 341 | — | 99.92 | 0.08 | — | — | 900.402 | 0.0323 |
| Ex. 342 | — | 99.92 | 0.08 | — | — | 999.932 | 0.0308 |
| Ex. 343 | — | 99.92 | 0.08 | — | — | 1100.061 | 0.0294 |
| Ex. 344 | — | 99.92 | 0.08 | — | — | 1200.049 | 0.0281 |
| Ex. 345 | — | 99.92 | 0.08 | — | — | 1300.53 | 0.027 |
| Ex. 346 | — | 99.92 | 0.08 | — | — | 1399.517 | 0.026 |
| Ex. 347 | — | 99.92 | 0.08 | — | — | 1499.903 | 0.025 |
| Ex. 348 | — | 99.92 | 0.08 | — | — | 1600.511 | 0.0242 |
| Ex. 349 | — | 99.92 | 0.08 | — | — | 1699.766 | 0.0234 |
| Ex. 350 | — | 99.92 | 0.08 | — | — | 1799.715 | 0.0226 |
| Ex. 351 | — | 99.92 | 0.08 | — | — | 1900.233 | 0.022 |
| Ex. 352 | — | 99.92 | 0.08 | — | — | 1999.653 | 0.0215 |
| Ex. 353 | — | 99.42 | 0.08 | 0.5 | — | 0.981 | 0.0139 |
| Ex. 354 | — | 99.42 | 0.08 | 0.5 | — | 2.11 | 0.0084 |
| Ex. 355 | — | 99.42 | 0.08 | 0.5 | — | 3.164 | 0.0659 |
| Ex. 356 | — | 99.42 | 0.08 | 0.5 | — | 4.289 | 0.1201 |
| Ex. 357 | — | 99.42 | 0.08 | 0.5 | — | 5.329 | 0.0989 |
| Ex. 358 | — | 99.42 | 0.08 | 0.5 | — | 5.88 | 0.1219 |
| Ex. 359 | — | 99.42 | 0.08 | 0.5 | — | 7.336 | 0.115 |
| Ex. 360 | — | 99.42 | 0.08 | 0.5 | — | 8.356 | 0.1177 |
| Ex. 361 | — | 99.42 | 0.08 | 0.5 | — | 8.958 | 0.1071 |
| Ex. 362 | — | 99.42 | 0.08 | 0.5 | — | 10.261 | 0.105 |
| Ex. 363 | — | 99.42 | 0.08 | 0.5 | — | 20.472 | 0.0916 |
| Ex. 364 | — | 99.42 | 0.08 | 0.5 | — | 29.983 | 0.0915 |
| Ex. 365 | — | 99.42 | 0.08 | 0.5 | — | 39.756 | 0.0897 |
| Ex. 366 | — | 99.42 | 0.08 | 0.5 | — | 49.896 | 0.0829 |
| Ex. 367 | — | 99.42 | 0.08 | 0.5 | — | 60.301 | 0.0799 |
| Ex. 368 | — | 99.42 | 0.08 | 0.5 | — | 69.536 | 0.0812 |
| Ex. 369 | — | 99.42 | 0.08 | 0.5 | — | 79.903 | 0.0783 |
| Ex. 370 | — | 99.42 | 0.08 | 0.5 | — | 90.371 | 0.0764 |
| Ex. 371 | — | 99.42 | 0.08 | 0.5 | — | 99.592 | 0.0743 |
| Ex. 372 | — | 99.42 | 0.08 | 0.5 | — | 200.567 | 0.0602 |
| Ex. 373 | — | 99.42 | 0.08 | 0.5 | — | 299.461 | 0.0545 |
| Ex. 374 | — | 99.42 | 0.08 | 0.5 | — | 400.511 | 0.0489 |
| Ex. 375 | — | 99.42 | 0.08 | 0.5 | — | 500.106 | 0.0446 |
| Ex. 376 | — | 99.42 | 0.08 | 0.5 | — | 600.226 | 0.0413 |
| Ex. 377 | — | 99.42 | 0.08 | 0.5 | — | 700.554 | 0.0385 |
| Ex. 378 | — | 99.42 | 0.08 | 0.5 | — | 800.185 | 0.0362 |
| Ex. 379 | — | 99.42 | 0.08 | 0.5 | — | 899.774 | 0.0341 |
| Ex. 380 | — | 99.42 | 0.08 | 0.5 | — | 999.701 | 0.0324 |
| Ex. 381 | — | 99.42 | 0.08 | 0.5 | — | 1100.55 | 0.0309 |
| Ex. 382 | — | 99.42 | 0.08 | 0.5 | — | 1199.651 | 0.0294 |
| Ex. 383 | — | 99.42 | 0.08 | 0.5 | — | 1299.973 | 0.0282 |
| Ex. 384 | — | 99.42 | 0.08 | 0.5 | — | 1399.995 | 0.027 |
| Ex. 385 | — | 99.42 | 0.08 | 0.5 | — | 1499.916 | 0.026 |
| Ex. 386 | — | 99.42 | 0.08 | 0.5 | — | 1599.649 | 0.0251 |
| Ex. 387 | — | 99.42 | 0.08 | 0.5 | — | 1699.539 | 0.0243 |
| Ex. 388 | — | 99.42 | 0.08 | 0.5 | — | 1800.048 | 0.0237 |
| Ex. 389 | — | 99.42 | 0.08 | 0.5 | — | 1899.699 | 0.0229 |
| Ex. 390 | — | 99.42 | 0.08 | 0.5 | — | 1999.722 | 0.0223 |
| Ex. 391 | — | 99.42 | 0.08 | — | 0.5 | 0.972 | 0.016 |
| Ex. 392 | — | 99.42 | 0.08 | — | 0.5 | 1.989 | −0.0398 |
| Ex. 393 | — | 99.42 | 0.08 | — | 0.5 | 3.093 | 0.0272 |
| Ex. 394 | — | 99.42 | 0.08 | — | 0.5 | 3.81 | 0.0674 |
| Ex. 395 | — | 99.42 | 0.08 | — | 0.5 | 5.287 | 0.0479 |
| Ex. 396 | — | 99.42 | 0.08 | — | 0.5 | 5.994 | 0.1307 |
| Ex. 397 | — | 99.42 | 0.08 | — | 0.5 | 6.401 | 0.1235 |
| Ex. 398 | — | 99.42 | 0.08 | — | 0.5 | 8.28 | 0.1223 |
| Ex. 399 | — | 99.42 | 0.08 | — | 0.5 | 8.803 | 0.125 |
| Ex. 400 | — | 99.42 | 0.08 | — | 0.5 | 9.711 | 0.1189 |
| Ex. 401 | — | 99.42 | 0.08 | — | 0.5 | 20.279 | 0.1092 |

TABLE 3-continued

| | Base oil (wt. %) | Base oil with additive package (wt. %) | Anti-wear agent (wt. %) | Friction modifier I (wt. %) | Fuel economy agent (wt. %) | Rolling Speed (mm/s) | Traction Coeff. |
|---|---|---|---|---|---|---|---|
| Ex. 402 | — | 99.42 | 0.08 | — | 0.5 | 30.583 | 0.1117 |
| Ex. 403 | — | 99.42 | 0.08 | — | 0.5 | 39.219 | 0.1038 |
| Ex. 404 | — | 99.42 | 0.08 | — | 0.5 | 49.983 | 0.0937 |
| Ex. 405 | — | 99.42 | 0.08 | — | 0.5 | 59.881 | 0.094 |
| Ex. 406 | — | 99.42 | 0.08 | — | 0.5 | 69.946 | 0.0925 |
| Ex. 407 | — | 99.42 | 0.08 | — | 0.5 | 78.827 | 0.0886 |
| Ex. 408 | — | 99.42 | 0.08 | — | 0.5 | 90.666 | 0.0879 |
| Ex. 409 | — | 99.42 | 0.08 | — | 0.5 | 99.16 | 0.0856 |
| Ex. 410 | — | 99.42 | 0.08 | — | 0.5 | 200.997 | 0.0692 |
| Ex. 411 | — | 99.42 | 0.08 | — | 0.5 | 299.773 | 0.0605 |
| Ex. 412 | — | 99.42 | 0.08 | — | 0.5 | 399.718 | 0.0545 |
| Ex. 413 | — | 99.42 | 0.08 | — | 0.5 | 499.974 | 0.0502 |
| Ex. 414 | — | 99.42 | 0.08 | — | 0.5 | 599.895 | 0.0463 |
| Ex. 415 | — | 99.42 | 0.08 | — | 0.5 | 700.405 | 0.0432 |
| Ex. 416 | — | 99.42 | 0.08 | — | 0.5 | 800.176 | 0.0405 |
| Ex. 417 | — | 99.42 | 0.08 | — | 0.5 | 899.676 | 0.0382 |
| Ex. 418 | — | 99.42 | 0.08 | — | 0.5 | 1000.108 | 0.036 |
| Ex. 419 | — | 99.42 | 0.08 | — | 0.5 | 1099.482 | 0.0342 |
| Ex. 420 | — | 99.42 | 0.08 | — | 0.5 | 1200.132 | 0.0326 |
| Ex. 421 | — | 99.42 | 0.08 | — | 0.5 | 1299.578 | 0.0311 |
| Ex. 422 | — | 99.42 | 0.08 | — | 0.5 | 1399.476 | 0.0298 |
| Ex. 423 | — | 99.42 | 0.08 | — | 0.5 | 1499.769 | 0.0285 |
| Ex. 424 | — | 99.42 | 0.08 | — | 0.5 | 1600.026 | 0.0274 |
| Ex. 425 | — | 99.42 | 0.08 | — | 0.5 | 1700.468 | 0.0265 |
| Ex. 426 | — | 99.42 | 0.08 | — | 0.5 | 1799.821 | 0.0256 |
| Ex. 427 | — | 99.42 | 0.08 | — | 0.5 | 1899.981 | 0.0248 |
| Ex. 428 | — | 99.42 | 0.08 | — | 0.5 | 2000.19 | 0.024 |

In FIG. 1, the traction coefficients for each of the lubricant compositions are plotted against the corresponding rolling speeds from 200 mm/s to 2000 mm/s as provided in Table 3 above. Lubricant compositions including the mixture of the alkoxylated amide and the ester (fuel economy agent) and the anti-wear agent including phosphorous exhibit lower traction coefficients at rolling speeds of at least 200 mm/s as compared to lubricant compositions including glycerol mono oleate (friction modifier I) and the anti-wear agent including phosphorous. At rolling speeds of less than 200 mm/s, the traction coefficients for the lubricant compositions including glycerol mono oleate (friction modifier I) and the anti-wear agent including phosphorous exhibit lower traction coefficients as compared to lubricant compositions including the mixture of the alkoxylated amide and the ester (fuel economy agent), and the anti-wear agent including phosphorous.

D. Fuel Economy Evaluation According to EPA Highway Fuel Economy Driving Schedule (HwFET)

The fuel economy improvement for vehicles utilizing lubricant composition was determined according to HwFET which is a chassis dynamometer driving schedule developed by the U.S. EPA for the determination of fuel economy of light duty vehicles. A 2012 Honda Civic (1.8 L PFI), a 2004 Mazda 3 (2.0 L PFI), a 2012 Buick Regal (2.0 L GDI), and a 2012 Ford Explorer (2.0 L TGDI) were utilized for the determination.

A total of four cycles were averaged to calculate the baseline fuel economy for each vehicle with each cycle including two HwFETs for a total of eight measurements. A mixture of the alkoxylated amide and ester, or an ester free of nitrogen was then introduced into the lubricant composition at the specified treat rate and four additional cycles were measured to calculate the impact of the mixture of the alkoxylated amide and ester, or the ester that is free of nitrogen on fuel economy. In accordance with HwFET, each vehicle was tested for 765 seconds to a distance of 10.26 miles at an average speed of 48.3 miles per hour. The results in Table 3 for each vehicle utilizing each lubricant composition are based on an average of 6 tests.

Examples 429-436 include the anti-wear agent including phosphorous, the ester free of nitrogen, and a Group II base oil. Examples 437-444 include an anti-wear agent including phosphorous, a mixture of the alkoxylated amide and ester, and a Group II base oil. Examples 437-444 also include a minor amount of by-products resulting and reactants remaining from the preparation of the alkoxylated amide of general formula (I) and the ester of general formula (II). The Group II base oil of Examples 429-444 also includes an additive package including each of the following additives in an amount based on a total weight percent of the Group II base oil: a dispersant at 3.4 wt. %, a phenolic antioxidant at 0.85 wt. %, an aminic antioxidant at 1.4 wt. %, a detergent at 1.8 wt. %, a diluent at 1 wt. %, a viscosity index improver at 3.2 wt. %, a pour point depressant, and antifoam agent.

The anti-wear agent including phosphorous is zinc dialkyldithiophosphate. The ester free of nitrogen is glycerol mono oleate. The mixture of alkoxylated amide and ester includes the alkoxylated amide and the ester in a weight ratio of 75:25 of the ester to the alkoxylated amide. Descriptions of the formulations of Examples of 87-102 are provided in Table 4 below. Results of the testing of Examples of 87-102 are provided in Table 5 below.

TABLE 4

| | Base oil (wt. %) | Anti-wear agent including phosphorous (wt. %) | Ester free of nitrogen (wt. %) | Mixture of the alkoxylated amide and ester (wt. %) | Additive package (wt. %) |
|---|---|---|---|---|---|
| Example 429 | 88.734 | 0.075 | 0.3 | — | 10.891 |
| Example 430 | 88.734 | 0.075 | 0.3 | — | 10.891 |
| Example 431 | 88.734 | 0.075 | 0.3 | — | 10.891 |

TABLE 4-continued

| | Base oil (wt. %) | Anti-wear agent including phosphorous (wt. %) | Ester free of nitrogen (wt. %) | Mixture of the alkoxylated amide and ester (wt. %) | Additive package (wt. %) |
|---|---|---|---|---|---|
| Example 432 | 88.734 | 0.075 | 0.3 | — | 10.891 |
| Example 433 | 88.434 | 0.075 | 0.6 | — | 10.891 |
| Example 434 | 88.434 | 0.075 | 0.6 | — | 10.891 |
| Example 435 | 88.434 | 0.075 | 0.6 | — | 10.891 |
| Example 436 | 88.434 | 0.075 | 0.6 | — | 10.891 |
| Example 437 | 88.734 | 0.075 | — | 0.3 | 10.891 |
| Example 438 | 88.734 | 0.075 | — | 0.3 | 10.891 |
| Example 439 | 88.734 | 0.075 | — | 0.3 | 10.891 |
| Example 440 | 88.734 | 0.075 | — | 0.3 | 10.891 |
| Example 441 | 88.434 | 0.075 | — | 0.6 | 10.891 |
| Example 442 | 88.434 | 0.075 | — | 0.6 | 10.891 |
| Example 443 | 88.434 | 0.075 | — | 0.6 | 10.891 |
| Example 444 | 88.434 | 0.075 | — | 0.6 | 10.891 |

TABLE 5

| | Vehicle | Fuel Economy Increase (%) | Average Fuel Economy Increase (%) |
|---|---|---|---|
| Example 429 | Mazda | 1.53 | 0.50 |
| Example 430 | Regal | 0.11 | |
| Example 431 | Civic | 0.07 | |
| Example 432 | Explorer | 0.30 | |
| Example 433 | Mazda | 1.19 | 0.73 |
| Example 434 | Regal | 0.66 | |
| Example 435 | Civic | 0.07 | |
| Example 436 | Explorer | 0.98 | |
| Example 437 | Mazda | 1.30 | 1.36 |
| Example 438 | Regal | 1.17 | |
| Example 439 | Civic | 1.68 | |
| Example 440 | Explorer | 1.27 | |
| Example 441 | Mazda | 1.96 | 1.45 |
| Example 442 | Regal | 1.00 | |
| Example 443 | Civic | 1.62 | |
| Example 444 | Explorer | 1.23 | |

Lubricant compositions including the ester free of nitrogen at 0.30 wt. % based on total weight of the lubricant composition exhibited increased fuel economy by an average of 0.50% as compared to the lubricant compositions free of the ester free of nitrogen as measured by the HwFET. Lubricant compositions including the mixture of the alkoxylated amide and ester at 0.30 wt. % based on total weight of the lubricant composition exhibited increased fuel economy by an average of 1.36% as compared to the lubricant compositions free of the mixture of the alkoxylated amide and ester as measured by the HwFET.

Lubricant compositions including the ester free of nitrogen at 0.60 wt. % based on total weight of the lubricant composition exhibited increased fuel economy by an average of 0.73% as compared to the lubricant compositions free of the ester free of nitrogen as measured by the HwFET. Lubricant compositions including the mixture of the alkoxylated amide and ester at 0.60 wt. % based on total weight of the lubricant composition exhibited increased fuel economy by an average of 1.45% as compared to the lubricant compositions free of the mixture of the alkoxylated amide and ester as measured by the HwFET.

E. Fuel Consumption Evaluation by Engine Dynamometer

The fuel consumption evaluation by engine dynamometer was conducted on an engine utilizing a lubricant composition.

The fuel consumption evaluation provides fuel consumption results at several time points over a 67.81 hour period. The engine utilized for the evaluation was a 5.7 liter GM crate engine. The engine was operated at controlled steady state conditions simulating highway temperatures, speed, and load. Fuel consumption was measured constantly with a Coriolis-type fuel flow meter.

At 0 hours, the lubricant composition included only Group II base oil. The engine was operated until the fuel consumption stabilized at 14.41 hours. This period from 0 hours to 14.41 hours is described as the "aging period." At 14.41 hours, an anti-wear agent including phosphorous in an amount of 0.03 wt. % was added to the lubricant composition such that the lubricant composition included the Group II base oil in combination with the anti-wear agent including phosphorous. At 17.08 hours, a mixture of the alkoxylated amide and ester in an amount of 0.3 wt. % was added to the lubricant composition such that the lubricant composition included the Group II base oil, the anti-wear agent including phosphorous and the mixture of the alkoxylated amide and ester.

The anti-wear agent including phosphorous was zinc dialkyldithiophosphate. The mixture of the alkoxylated amide and ester is a mixture of the alkoxylated amide of general formula (I) and the ester of general formula (II) along with a minor amount of by-products resulting and reactants remaining from the preparation of the alkoxylated amide of general formula (I) and the ester of general formula (II). The mixture of alkoxylated amide and ester includes the alkoxylated amide and the ester in a weight ratio of 75:25 of the ester to the alkoxylated amide. Results of the evaluation are provided in Table 6 below and graphically in FIG. 2.

TABLE 6

| | Lubricant Composition | | | |
|---|---|---|---|---|
| Time point/Time period | Base oil | Anti-wear agent including phosphorous | Mixture of the alkoxylated amide and ester | Fuel Consumption (g/sec) |
| A/0 to 14.41 hours | Yes | No | No | 2.388 |
| B/14.41 to 17.08 hours | Yes | Yes | No | 2.458 |
| C/17.08 to 19.58 hours | Yes | Yes | Yes | 2.392 |
| D/19.58 to 67.81 hours | Yes | Yes | Yes | 2.307 |

Figure 2:
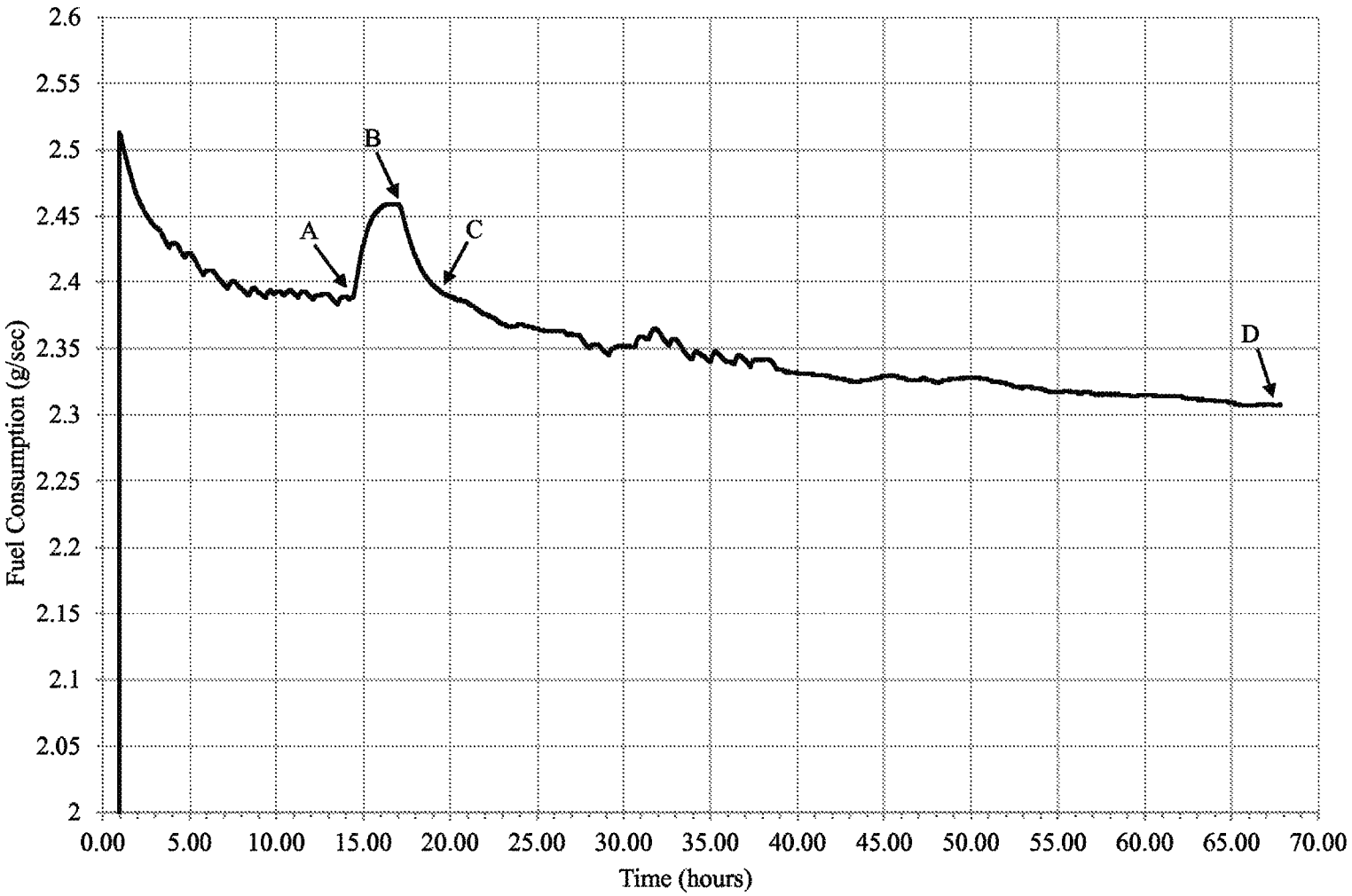
FIG. 2 is a graphical representation of a fuel consumption evaluation of another embodiment of the lubricant composition.

As shown in Table 6 and FIG. 2, during the aging period from 0 hours to 14.41 hours (time point A at 14.41 hours), fuel consumption of the engine stabilized at 2.388 g/sec. After addition of the anti-wear agent including phosphorous to the lubricant composition, fuel consumption of the engine was 2.458 g/sec at 17.08 hours (time point B at 17.08 hours). This addition of the anti-wear agent including phosphorous resulted in an increase of fuel consumption of 2.85% relative to the lubricant composition of the aging period. After addition of the mixture of the alkoxylated amide and ester to the lubricant composition, fuel consumption of the engine was 2.392 g/sec at 19.58 hours (time point C at 19.58 hours). Thus, the addition of the mixture of the alkoxylated amide and ester resulted in a decrease of fuel consumption of 2.76% compared to the lubricant composition without the mixture of the alkoxylated amide and ester. After 67.81 hours (time point D at 67.81 hours), fuel consumption of the engine was 2.307 g/sec.

The fuel consumption of the engine at 67.81 hours utilizing the lubricant composition that included the anti-wear agent including phosphorous, and the mixture of the alkoxylated amide and the ester, decreased 3.51% compared to the fuel consumption of the engine at 14.41 hours utilizing the lubricant composition that included only the anti-wear agent including phosphorous. The fuel consumption of the engine at 67.81 hours utilizing the lubricant composition decreased 6.55% compared to the fuel consumption of the engine at 17.08 hours. It is believed that the mixture of the alkoxylated amide and ester in the lubricant composition including the anti-wear agent including phosphorous mitigates the increased fuel consumption of the engine utilizing a lubricant composition including the anti-wear agent including phosphorous.

In addition to the Fuel Consumption Evaluation by Engine Dynamometer described above, a further Fuel Consumption Evaluation by Engine Dynamometer was conducted. During this evaluation, the mixture of the alkoxylated amide and the ester was added to the lubricant composition after the aging period. After 3 hours, the anti-wear agent including phosphorus was added to the lubricant composition. The results of this evaluation provided that the fuel consumption of the engine only increased after addition of the anti-wear agent including phosphorus. Without intending to be bound by theory, it is believed that the performance of the alkoxylated amide and the ester may be dependent upon the presence of a tribofilm formed from the anti-wear agent including phosphorus.

F. Effectiveness of Bench Tests in Determining Fuel Economy

The evaluations described above utilizing HFRR and MTM for determining concepts related to friction are commonly considered to be bench tests. These tests may be utilized to quickly and cost-effectively screen a large number of lubricant compositions for concepts related to friction. However, looking at the evaluations described above as a whole, concepts related to friction may not necessarily correlate to fuel economy. For example, if one were to only evaluate a lubricant composition including glycerol mono oleate against a lubricant composition including the mixture of the alkoxylated amide and ester utilizing bench tests, one may incorrectly determine that lubricant compositions including glycerol mono oleate exhibit increased fuel economy based on concepts related to friction as compared to lubricant compositions including the mixture of the alkoxylated amide and ester. In view of the HwFET evaluation describe above, which is commonly utilized by OEMs to determine the fuel economy of vehicles, the lubricant composition including the mixture of the alkoxylated amide and ester exhibits increased fuel economy in engines as compared to the lubricant composition including glycerol mono oleate in engines.

It is believed that bench tests which screen lubricant compositions for concepts related to friction may be unable to simulate the complex environment of an operating engine due to bench tests only simulating one set of conditions. The complex environment of an engine includes many moving parts all moving at different speeds, each of the parts with different metallurgy, hardness, stiffness, and geometry with these parts contacting with varying loads and temperatures and with different degrees of boundary lubrication and transient conditions. Further, the lubricant composition is continuously changing as it ages due to heat, the accumulation of combustion products, and changes in chemistry as additives activate, react, and decompose. For example, an engine operating for a longer duration and at a higher temperature may be more likely to exhibit tribofilm formed from the anti-wear additive on surfaces of metal parts of the engine. As described above, it is believed that the mixture of the alkoxylated amide and ester may absorbs onto the tribofilm to reduce the friction coefficient of the layer of the anti-wear agent present on the surface of the engine. Without the formation of the tribofilm during bench tests, the alkoxylated amide and ester may not reduce the friction coefficient of the layer of the anti-wear agent present on the surface of the engine. Accordingly, it is believed that bench tests which screen lubricant compositions for concepts related to friction may not be an effective method of determining the fuel economy of a lubricant composition in an engine.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and or in combination and provides adequate support for specific embodiments within the scope of the appended claims.

It is also to be understood that any ranges and subranges relied upon in describing various embodiments of the present disclosure independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present disclosure, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims.

In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The present disclosure has been described herein in an illustrative manner, and it is to be understood that the terminology which has been used is intended to be in the nature of words of description rather than of limitation. Many modifications and variations of the present disclosure are possible in light of the above teachings. The present disclosure may be practiced otherwise than as specifically described within the scope of the appended claims. The subject matter of all combinations of independent and dependent claims, both single and multiple dependent, is herein expressly contemplated.

What is claimed is:

1. A lubricant composition comprising:

(A) a base oil;

(B) an alkoxylated amide having a general formula (I):

(I)

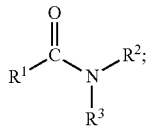

(C) an ester having a general formula (II):

(II)

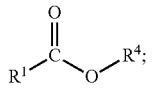

wherein;

each $R^1$, $R^2$, $R^3$, and $R^4$, is, independently, a linear or branched, saturated or unsaturated, hydrocarbyl group, at least one of $R^2$ and $R^3$ comprises an alkoxy group, and $R^4$ comprises an amine group; and (D) an anti-wear agent comprising phosphorus, molybdenum, or a combination thereof.

2. The lubricant composition of claim 1 wherein at least one of $R^2$ and $R^3$ of said alkoxylated amide comprises a propoxy group.

3. The lubricant composition of claim 1 wherein:

$R^2$ of said alkoxylated amide has a general formula (III):

(III)

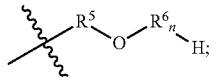

and $R^3$ of said alkoxylated amide has a general formula (IV):

(IV)

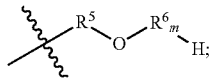

wherein each $R^5$ is, independently, an alkyl group, each $R^6$ is, independently, an alkoxy group, n is an integer from 0 to 5, m is an integer from 0 to 5, and $1 \leq (n+m) \leq 5$.

4. The lubricant composition of claim 1 wherein $R^4$ has a general formula (V):

(V)

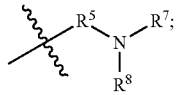

wherein $R^5$ is an alkyl group, and each $R^7$ and $R^8$ is, independently, a linear or branched, saturated or unsaturated hydrocarbyl group.

5. The lubricant composition of claim 4 wherein:

$R^7$ is a hydrocarbyl group having a general formula (VI):

(VI)

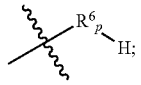

and $R^8$ is a hydrocarbyl group having a general formula (VII):

(VII)

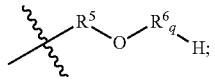

wherein each $R^5$ is, independently, an alkyl group, each $R^6$ is, independently, an alkoxy group, q is an integer from 0 to 5, if q is 0, p is an integer from 0 to 5, if q is >0, p is an integer from 1 to 5, and $0 \leq (p+q) \leq 5$.

6. The lubricant composition of claim 1 wherein $R^1$ of said alkoxylated amide and said ester are each, independently, a linear or branched, saturated or unsaturated, $C_7$-$C_{23}$ aliphatic hydrocarbyl group.

7. The lubricant composition of claim 6 wherein $R^1$ of said alkoxylated amide or said ester comprises a hydroxyl group.

8. The lubricant composition of claim 1 wherein:

said alkoxylated amide has a general formula (VIII):

$$R^1—C(=O)—N[R^5—O—R^6_n—H][R^5—O—R^6_m—H] \quad \text{(VIII);}$$

and said ester has a general formula (IX):

$$R^1—C(=O)—O—R^5—N[R^5—O—R^6_q—H][R^6_p—H] \quad \text{(IX);}$$

wherein each $R^1$ is, independently, a linear or branched, saturated or unsaturated, $C_7$-$C_{23}$ aliphatic hydrocarbyl group, each $R^5$ is, independently, an alkyl group, each $R^6$ is, independently, an alkoxy group, n is an integer from 0 to 5, m is an integer from 0 to 5, $1 \leq (n+m) \leq 5$, q is an integer from 0 to 5, if q is 0, p is an integer from 0 to 5, if q is >0, p is an integer from 1 to 5, and $0 \leq (p+q) \leq 5$.

9. The lubricant composition of claim 8 wherein:

each $R^1$ is, independently, a linear or branched, saturated or unsaturated, $C_7$-$C_{23}$ aliphatic hydrocarbyl group;

each $R^5$ is, independently, an ethyl group or a propyl group;

each $R^6$ is, independently, a propoxy group;

n is an integer from 0 to 5;

m is an integer from 0 to 5;

$1 \leq (n+m) \leq 5$;

q is an integer from 0 to 5;

if q is 0, p is an integer from 1 to 5;

if q is >0, p is an integer from 1 to 5;

$1 \leq (p+q) \leq 5$; and said lubricant composition comprises said alkoxylated amide and said ester in a weight ratio of less than 70:30 of said ester to said alkoxylated amide.

10. The lubricant composition of claim 1 wherein said base oil is further defined as a crankcase lubricant composition.

11. The lubricant composition of claim 1 wherein said base oil comprises an API Group I Oil, an API Group II Oil, an API Group III Oil, an API Group IV Oil, or combinations thereof, and wherein said base oil has a viscosity ranging from 1 to 20 cSt when tested at 100° C. according to ASTM D445.

12. The lubricant composition of claim 1 comprising said alkoxylated amide and said ester in a weight ratio of less than 50:50 of said ester to said alkoxylated amide.

13. The lubricant composition of claim 1 wherein said alkoxylated amide is present in an amount of from 0.01 to 20 wt. % based on the total weight of said lubricant composition.

14. The lubricant composition of claim 1 wherein said ester is present in an amount of from 0.01 to 20 wt. % based on the total weight of said lubricant composition.

15. The lubricant composition of claim 1 wherein said anti-wear agent is present in an amount of from 0.001 to 30 wt. % based on the total weight of said lubricant composition.

16. A method of lubricating an internal combustion engine for improving the fuel economy of the internal combustion engine, said method comprising:

providing a lubricant composition comprising:

(A) a base oil;

(B) an alkoxylated amide having a general formula (I):

(I)

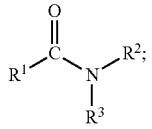

(C) an ester having a general formula (II):

(II)

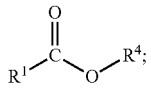

wherein;

each $R^1$, $R^2$, $R^3$, and $R^4$, is, independently, a linear or branched, saturated or unsaturated, hydrocarbyl group, at least one of $R^2$ and $R^3$ comprises an alkoxy group, and $R^4$ comprises an amine group; and (D) an anti-wear agent comprising phosphorus, molybdenum, or a combination thereof; and lubricating the internal combustion engine with the lubricant composition.

17. The method of claim 16 wherein the anti-wear agent is a zinc dialkyl dithiophosphate.

18. An additive package for a lubricant composition, said additive package comprising:

(A) an alkoxylated amide having a general formula (I):

(I)

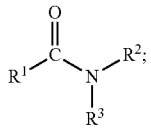

(B) an ester having a general formula (II):

(II)

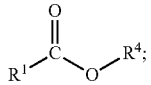

wherein each $R^1$, $R^2$, $R^3$, and $R^4$ is, independently, a linear or branched, saturated or unsaturated hydrocarbyl group, at least one of $R^2$ and $R^3$ comprises an alkoxy group, and $R^4$ comprises an amine group; and (C) an anti-wear agent comprising phosphorus, molybdenum, or a combination thereof.

19. The additive package of claim 18 wherein said anti-wear agent is a zinc dialkyl dithiophosphate.

* * * * *